US005325281A

United States Patent [19]

Harwood

[11] Patent Number: 5,325,281

[45] Date of Patent: Jun. 28, 1994

[54] ADJUSTABLE LIGHTING SYSTEM WITH OFFSET POWER INPUT AXIS

[75] Inventor: Ronald P. Harwood, Farmington Hills, Mich.

[73] Assignee: Thomas Industries, Inc., Louisville, Ky.

[21] Appl. No.: 940,942

[22] PCT Filed: Feb. 27, 1992

[86] PCT No.: PCT/U592/01552

§ 371 Date: Nov. 17, 1992

§ 102(e) Date: Nov. 17, 1992

Related U.S. Application Data

[63] Continuation-in-part of Ser. No. 662,430, Feb. 28, 1991, Pat. No. 5,140,507, which is a continuation-in-part of Ser. No. 529,090, May 24, 1990, abandoned.

[51] Int. Cl.[5] ..... F21V 21/14

[52] U.S. Cl. ..... 362/271; 362/275; 362/287; 362/419; 362/428; 248/278

[58] Field of Search ..... 362/233, 271, 272, 273, 362/275, 286, 287, 289, 418, 419, 422, 427, 428, 404, 147; 248/278; 403/55, 59

[56] References Cited

U.S. PATENT DOCUMENTS

| | | | |
|---|---|---|---|
| 1,448,791 | 3/1923 | Coffeen | 362/422 |
| 1,672,900 | 6/1928 | Nichols | 362/419 |
| 1,720,836 | 7/1929 | Hummert | 362/422 |
| 1,981,204 | 11/1934 | Sklarek | 362/422 |
| 2,147,953 | 2/1939 | Tornblom | 362/422 |
| 4,727,460 | 2/1988 | Payne | 362/275 |
| 4,814,955 | 3/1989 | Price | 362/419 |
| 4,887,186 | 12/1989 | Brown et al. | 362/148 |
| 4,931,917 | 6/1990 | Scherf et al. | 362/275 |

*Primary Examiner*—Richard R. Cole
*Attorney, Agent, or Firm*—Marshall & Melhorn

[57] ABSTRACT

An adjustable lighting fixture has a power transfer means interposed between a lamp holder and the point of mounting. The power transfer means has an input shaft, which may be offset from the point of mounting, such as a fixture mounting pole, or in line therewith, and an output shaft which rotates in response to the rotation of the input shaft about its own axis. When the axis of power input is in line with the point of mounting, a physical rotation of the power transfer means will cause the rotation of the lamp holder about an axis extending through the point of mounting. When the axis of power input is offset from the point of mounting, an orbital input about the axis of the power input, or in other words an orbiting of the power input shaft about the axis extending through the point of mounting, will cause rotation of the lamp holder about said axis extending through the point of mounting. In a modification of the invention, a recessed adjustable lighting fixture is provided where an offset power transfer means is connected to a housing for rotation. The offset power transfer means has a single axis or node of power input to produce rotation of the lamp holder about two axes of rotation.

46 Claims, 14 Drawing Sheets

ADJUSTABLE LIGHTING SYSTEM WITH OFFSET POWER INPUT AXIS

BACKGROUND OF THE INVENTION

The present application is continuation of PCT/U.S.92/01552 filed Feb. 27, 1992 which is a continuation-in-part of my earlier co-pending patent application Ser. No. 07/662,430, filed Feb. 28, 1991 now U.S. Pat. No. 5,190,507, for Adjustable Lighting System, which is a continuation-in-part of earlier co-pending patent application, Ser. No. 07/529,090, filed May 24, 1990, now abandoned for Adjustable Lighting System. The specification of said earlier, co-pending, application Ser. No. 07/662,430 is specifically incorporated herein by reference. The present application discloses additional modifications to the adjustable lighting system shown in said co-pending prior applications.

DESCRIPTION OF THE PRIOR ART

Lighting systems employing spotlights have been used in the art for many years as a convenient means of focusing a large of amount of light on an object. They have been used in various fields, such as in museums to highlight displays, in theaters during stage plays, to focus lights on the performers, and in retail establishments to focus light on objects being highlighted in sales displays. Although the present invention is usable in many fields, for ease of explanation, its relationship to the prior art will be explained from the point of lighting systems used to highlight merchandise in large retailing establishments.

Practically no matter how such prior art systems were used in retailing establishments, they presented serious problems in the art. If used on the sales floor of such retailing establishments to highlight merchandise, they would typically be mounted near the ceiling of such retail establishments, which are much higher than ceilings found in the home, for example. While they were trouble-free in operation, problems arose as soon as the retail floor was rearranged, and the need to adjust the spotlights used in such systems came into being. The most obvious of these problems involves the safety of the store personnel who are to adjust the spotlights. Such adjustment normally requires that the store personnel climb on top of very tall ladders, raising the possibility of injury from falls and the like.

Additionally, there were electrical and burn hazards involved with such adjustments. The possibility of electrical shock was always present unless the spotlights were turned off while being adjusted. Since repeatedly turning the spotlights on and off while adjusting them in small increments greatly increased the time needed for adjustment, typically the spotlights were left on while being adjusted, resulting in the store personnel frequently being burned, even when wearing heavy leather gloves.

Those skilled in the art were thus presented the problem of how to adjust the spotlights during normal business hours while eliminating these hazards. This required either that they be adjusted after hours, or that merchandise be sold without the normal highlighting, thus affecting the sales of the retail establishment. In the lighting system of the present invention, all these problems are largely eliminated, as the luminaires used in the system can easily be adjusted while the system is in operation.

Additionally, merchandise right under the spotlights, or near the fixtures to be adjusted, had to either be moved, or great difficulty was presented getting a ladder in position to adjust them. Also, the possibility of burns would be presented if the spotlights were not turned off and given sufficient time to cool before attempting to adjust them.

As difficult as adjusting the spotlights was, they were found to be such an aid to retailing that the difficulties would be accommodated each time merchandise was moved because spotlights which were not adjusted properly were a waste of electrical energy, and created useless heat as well as detracting from the sale of merchandise.

Another serious problem arises where the spotlights are used in store windows to highlight a mannequin. In contrast to the problem presented when spotlights are used on the sales floor of large retailing establishments, the use of the spotlight to highlight a mannequin in the store window presents the same problems, but for the opposite reasons. Usually, when highlighting mannequins, the spotlights are located in very cramped quarters, where even a regular-size ladder presents problems, as it may not easily fit into the space occupied by the mannequin.

Even if the ladder can be positioned in the store window or other location where the mannequin is located, there is a very cramped space for the operator to work, making the possibility of electrical shock or burn no less than when the fixture is installed at or near the ceiling of a retail establishment and, in fact, increases the problem.

In view of the problems in the present art, attempts have been made to provide for adjustment of lighting fixtures without touching the fixtures themselves. For example, various models of spotlights made by Capri Lighting, such as the KR851 Pyramid Spotlight and others, have an adjustment knob spaced from the housing which may be rotated to rotate the spotlight. However, one must still reach the knob either in the cramped spaced provided in the stored window or at great heights such as in the retail establishment, and so very little advantage is provided by this knob in the view of the hazards presented. The problems of reaching the fixture and coping with the heat and electrical problems are not eliminated by the mere providing of an adjustment knob.

As longstanding as these problems have been in the retailing industry, there has been no satisfactory solution until the time of the present invention.

SUMMARY OF THE INVENTION

In order to largely eliminate the problems present in the prior art, I have provided a lighting system employing a lighting fixture which, when used in a retail establishment, is adaptable for use as a spot light or track light. This system provides an adjustment means connectable to a power transfer means which is interposed between the fixture mounting pole, whether mounted to a canopy or a standard track head, and the luminaire to be adjusted. The system further provides a power transfer means mounted to a rotatable fixture mounting pole which, by virtue of having its housing mounted to the pole, provides for rotation about the axis of the pole when the housing is physically turned by a remote adjustment wand. Alternately, the pole may remain stationary, and the housing may rotate.

Rotation about a second axis is possible by attaching the lighting fixture itself to the output shaft of the power transfer means. By the use of a hollow adjustment wand, the outside of which is adapted to physically rotate the housing, and the inside of which rotates the input shaft of the power transfer means and thus, also the output shaft attached to the lighting fixture, rotation of the spotlights about two different axes from a remote location is provided for.

In a first modification of the invention, the position of the power transfer means is reversed. The power transfer means is mounted on the end of the hollow adjustment wand, instead of being mounted at the end of the fixture mounting pole. In this embodiment, a physical rotation of the hollow adjustment wand will still physically rotate the housing about a first axis, and a rotation of the inside of the hollow adjustment wand will rotate the output shaft of the power transfer means, which is attached to a connector drivingly connected to the lighting fixture, for rotation about a second axis.

In a second modification of the present invention, the power transfer means is split between the hollow adjustment wand and the end of the fixture mounting pole to provide for rotation of the light fixture about two axes of rotation.

In a third modification of the present invention, an axis of power input is offset from one of the axes of rotation, and a solid wand is used. Orbiting the wand in a circle about the first axis of rotation rotates the lamp holder or luminare about said first axis of rotation. Rotating the solid wand about the offset axis of power input rotates the lamp holder about the other axis of rotation.

In a fourth modification of the present invention, the offset axis of power input, and the solid wand, are used to provide a rotatable, adjustable, recessed lighting fixture.

The result of any of the different forms of the invention is a lighting fixture which can easily be adjusted from the sales floor of a retailing establishment when a light is mounted at or near the ceiling, without the movement of any merchandise, and a lighting fixture which is just as easily adjusted when used in a cramped location.

Thus, one of the objects of the present invention is to provide a lighting fixture mountable in a wide variety of locations which may be rotated about two different axis planes from a remote location.

A further object of the present invention is to provide a lighting fixture usable in track lighting systems commonly found in large retailing establishments which may be adjusted from the sales floor of such establishments, even though the track light is mounted at or near the ceiling in such stores.

A still further object of the present invention is to provide a track lighting fixture which may be easily adjusted while in operation without presenting an electrical hazard to the adjusting personnel.

Another object of the invention is to provide a track lighting fixture which may easily be adjusted from a remote location without presenting any burn hazard to the adjusting personnel.

Another object of the present invention is to provide for an adjustable track lighting fixture which may be adjusted without the need for ladders and the like.

Another object of the present invention is to provide for a lighting fixture which may be adjusted without disruption of the retail environment during business hours.

A still further object of the present invention is to provide for an adjustable lighting fixture which may be adjusted without presenting any danger to customers.

A still further object of the present invention is to provide a lighting fixture of the foregoing nature which is adaptable to a wide variety of uses.

A still further object of the present invention is to provide a method of converting existing track lighting fixtures to track lighting fixtures adjustable about two different axes from a remote location.

A further object of the present invention is to provide a lighting fixture having a single axis of power input which can produce rotation about two axes of rotation.

A further object of the present invention is to provide a lighting fixture having a single axis of power input which can produce rotation about two axes of rotation, wherein said axis of power input is offset from one of said axes of rotation.

A still further object of the present invention is to provide an adjustable recessed lighting fixture having a single axis of power input to produce rotation about two axes of rotation, wherein said axis of power input is offset from one of said axes of rotation.

Further objects and advantages of the present invention will be apparent from the following description and appended claims, reference being made to the accompanying drawings forming a part of the specification, wherein like reference characters designate corresponding parts in the several views.

It is to be understood that the present invention is not limited to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DETAILED DESCRIPTION OF THE PREFERRED EMBODIMENTS

It should be understood that the scope of the present invention is very broad. The lighting system disclosed herein is usable anywhere an adjustable lighting fixture is desired, and not just in display windows or in retail establishments. For ease of understanding, the present invention will first be described in an embodiment wherein the adjustable lighting fixture is used as a track light mountable through a track head to a conventional lighting track of the type used in retail establishments. Even in regard to this embodiment, however, it should be understood that a track head is not essential, and the fixture mounting pole to be described can be mounted directly to a canopy, if desired.

Figure 2C:
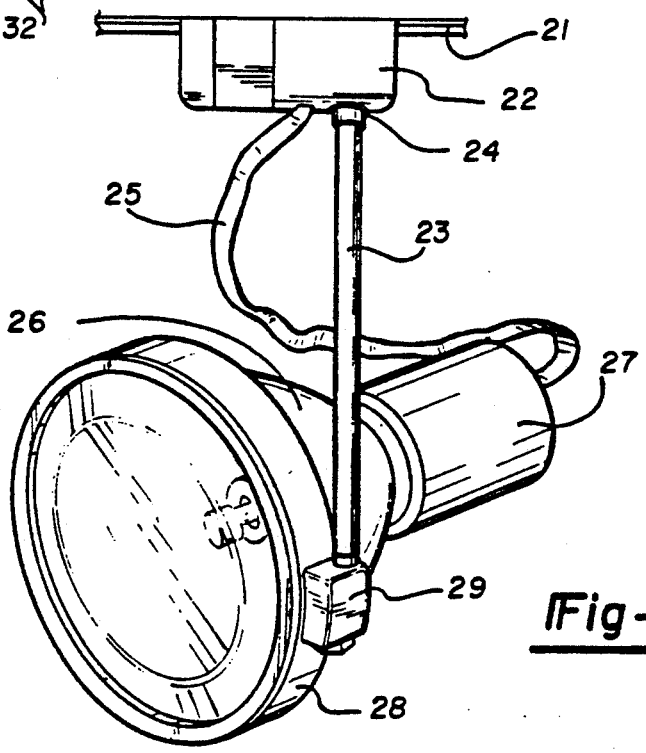
FIG. 2C is an enlarged perspective view of one of the lighting fixtures shown in FIG. 1.
Figure 2A:
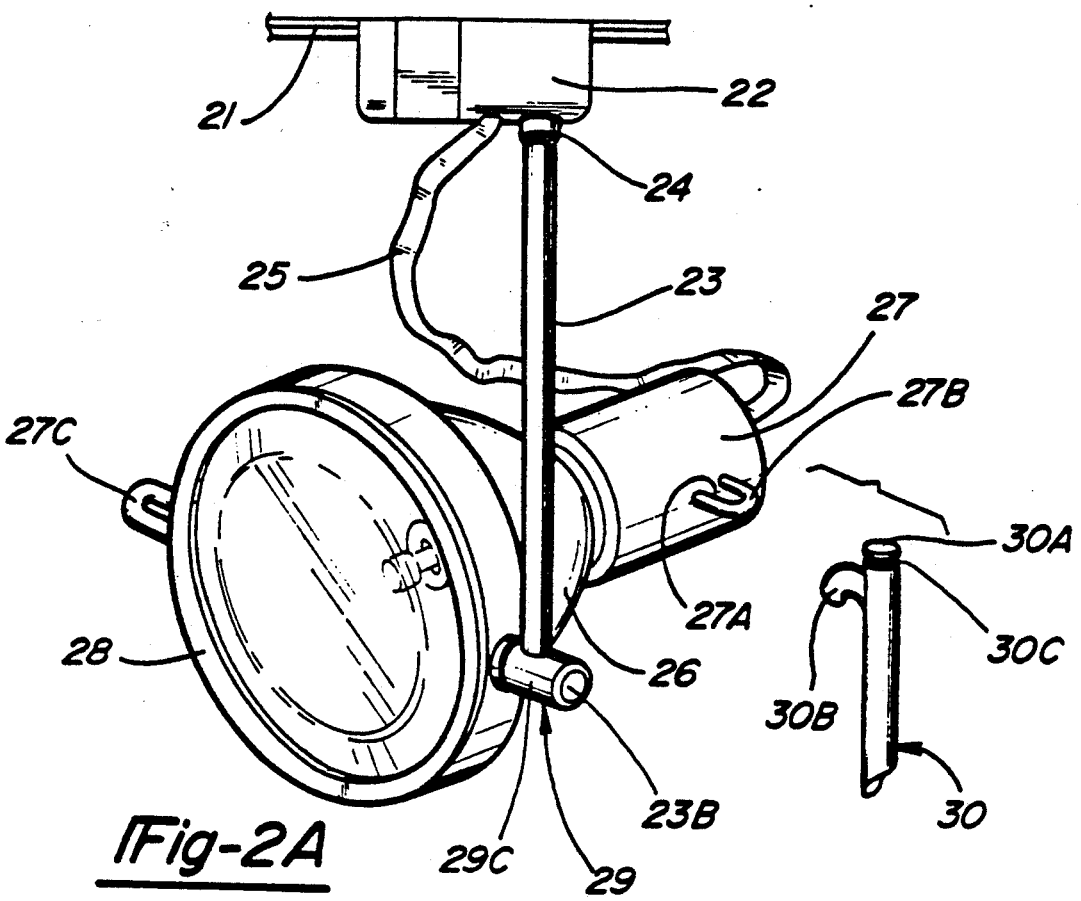
FIG. 2A is an enlarged perspective view of one embodiment of the present invention.
Figure 2B:
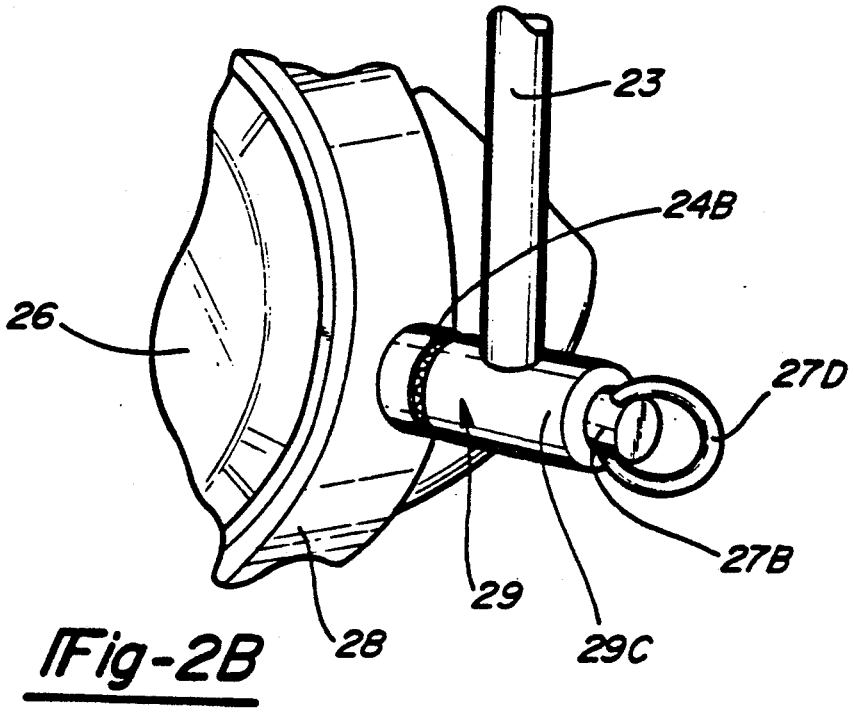
FIG. 2B is a partial perspective view showing a modification of the construction shown in FIG. 2A.

Referring to FIGS. 2A and 2B, there is shown an embodiment of the present invention providing a basic solution to the previously described problems in the present art. In this embodiment of the invention, there is shown a lighting track 21 which supplies power to a track head 22 to which is mounted a fixture mounting pole 23. The fixture mounting pole may either be fixedly mounted to the track head or mounted for rotation thereto. If the fixture mounting pole 23 is mounted for rotation to the track head 22, a manual tensioning ring 24 may be added to provide the desired friction to prevent unwanted rotation of the fixture mounting pole 23.

Power is supplied from the track head 22 through the power cord 25 to the socket 27 in which is mounted a lamp 26 which is held in a luminaire or lamp holder, such as gimbal ring 28. It should be understood that each different lamp which is used in the improved lighting fixture of the present invention, may require a different "lamp holder". Therefore, this term should be understood in a generic sense to mean any apparatus which is attached to the power transfer means and provides a source of light. A power transfer means 29 is provided at the lower end of the fixture mounting pole 23, including a bushing portion 29C in which is journaled for rotation shaft 23B. If the fixture mounting pole 23 is rotatably mounted to the track head 22, and a manual tensioning ring 24 or friction washer is provided to restrict unwanted rotation, the power transfer means 29 may be fixedly mounted to the lower end of the mounting pole 23. If the mounting pole 23 is fixedly mounted to the track head 22, the bushing portion 23B may be rotatably connected to the fixture pole 23, and the friction means or tension ring 24 may be provided at the lower end of the mounting pole 23.

At one end of the shaft 23B is mounted the lamp holder or gimbal ring 28. To the lamp socket 27 at a single node or point of power input 27A is connected an attachment ring or loop 27B. For reasons to be explained, the attachment ring 27B preferably is mounted in a horizontal plane. An adjustment means 30, having at its upper end a straight portion 30A and an angled portion 30B, may be used to adjust the direction of the lamp 26. It can be seen if the straight end 30A is inserted into the adjustment loop 27B, and the pole is moved up and down, the lamp 26 will rotate about the axis of the shaft 23B. If the adjustment means 30 is orbited about the first axis of rotation, which is the axis of the fixture pole 23, the lamp 26 will rotate about the first axis of rotation or the fixture pole 23. A knob-like portion 30C may be provided on portion 30A if desired.

Since the use of a single adjustment ring 27B puts stress on the lamp 26 and might result in breakage, it may be desirable to use a second adjustment ring 27C, which is attached to the gimbal ring 28 so that when it is desired to rotate the lamp about the first axis of rotation, the straight end 30A of the adjustment means 30 may be inserted in the second ring 27C.

In a further embodiment of the invention shown in FIG. 2B, it can be seen that the other end of the shaft 23B is extended, and a single adjustment ring 27D is used, which is fixedly attached to the shaft. A movement of the adjustment means 30 fore and aft by the operator rotates the lamp 26 about the axis of the shaft or second axis of rotation, and an orbiting of the ring 27C about the first axis of rotation, rotates the lamp 26 about the axis of the fixture pole 23.

Figure 1:
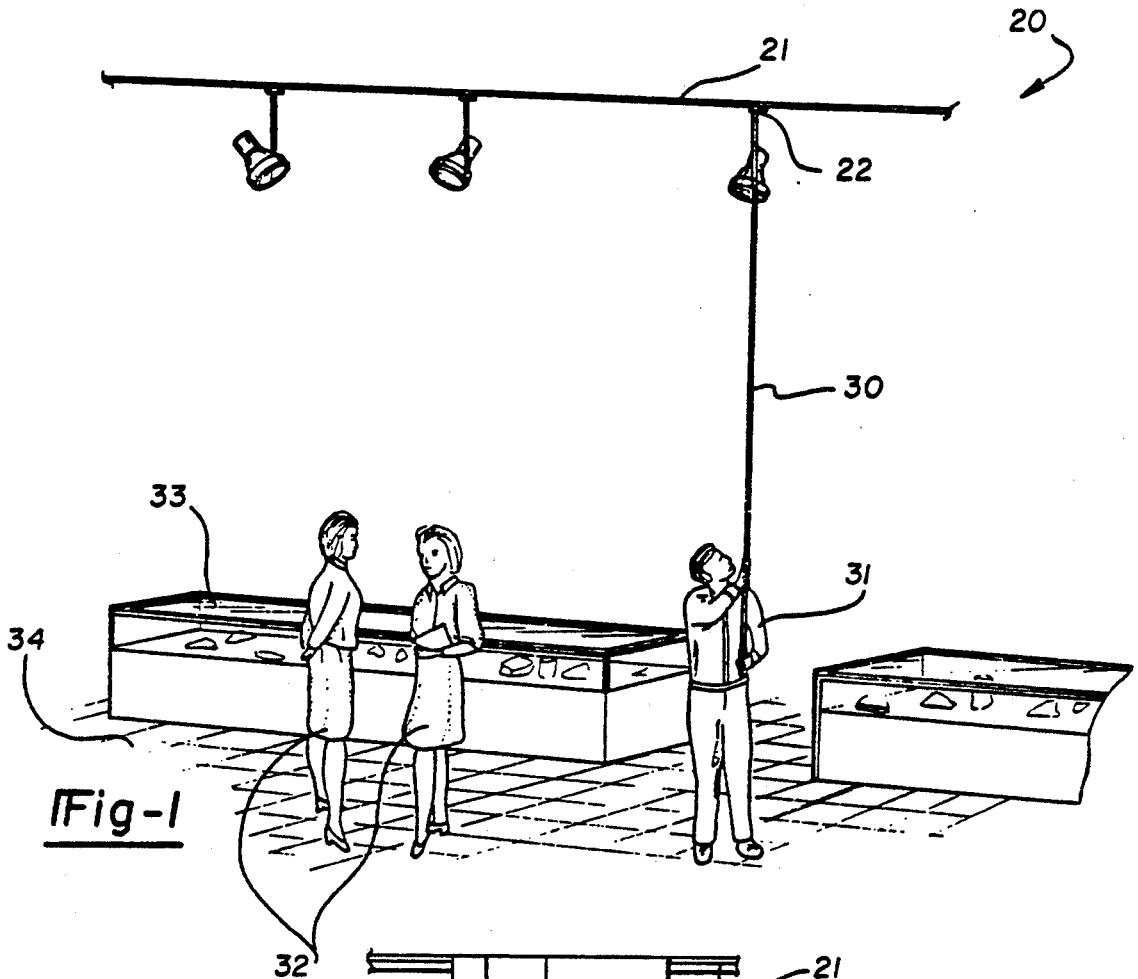
FIG. 1 is a pictorial view showing a construction embodying the present invention installed in a retailing establishment.
Figure 15:
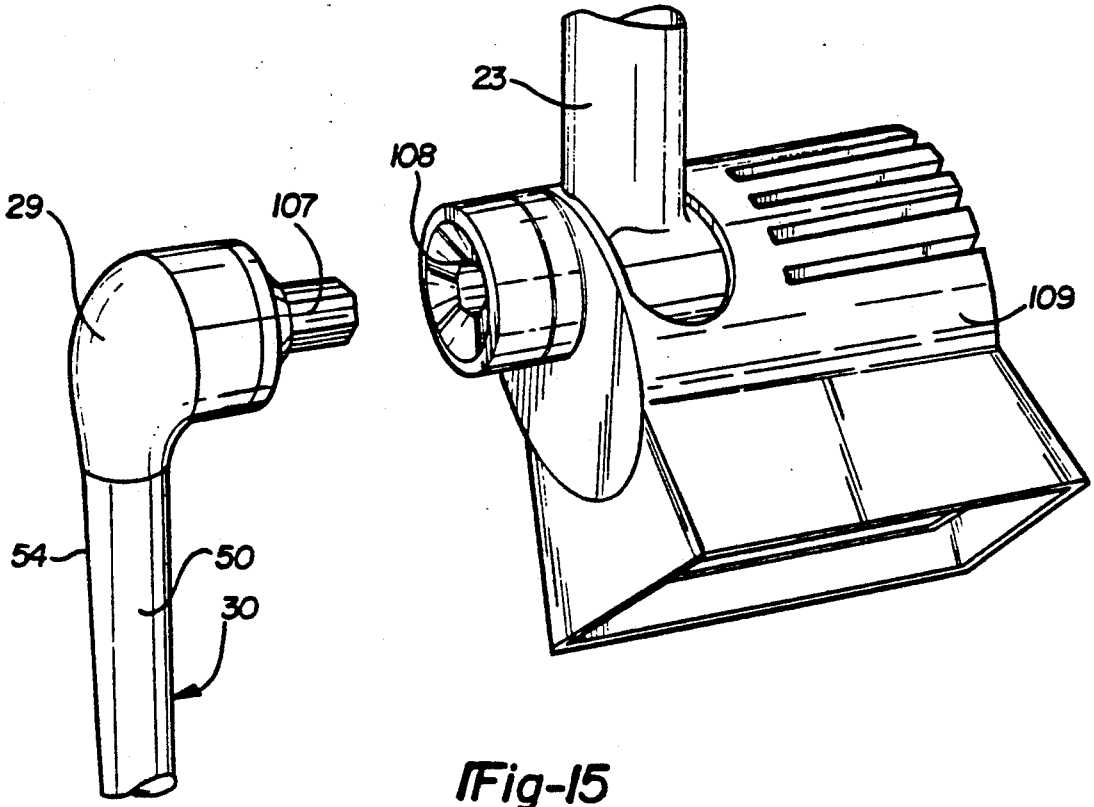
FIG. 15 is a modification of the present invention, wherein the power transfer means are placed at the end of the hollow adjusting wand.
Figure 17:
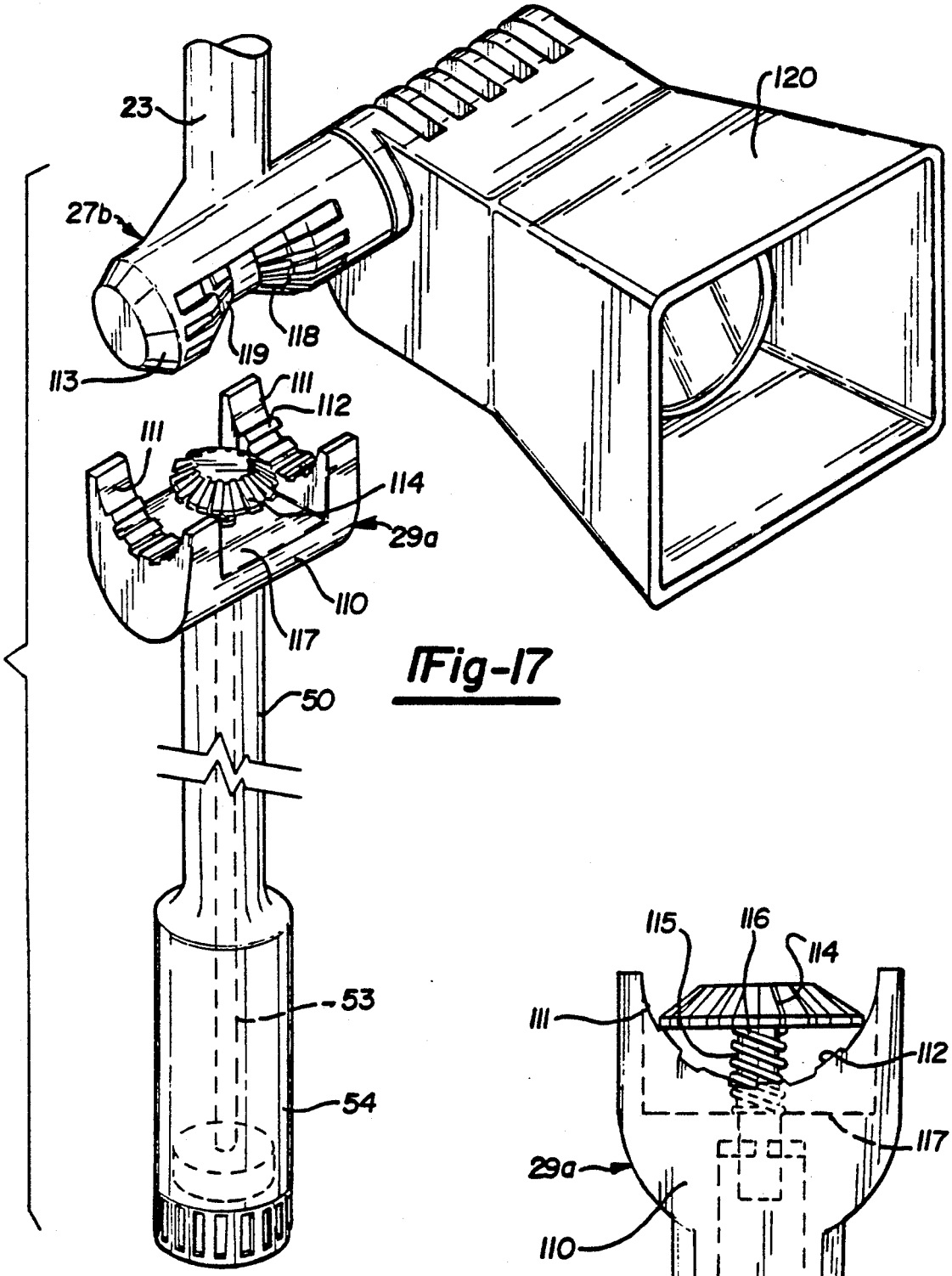
FIG. 17 is a perspective view of a modification of the present-invention, employing the power transfer means shown in FIG. 16.

It can be seen that in this basic embodiment of the invention, the adjustment of even a single lighting fixture may involve the movement of the adjustment means 30 between a first adjustment ring 27B and a second adjustment ring 27C several times. If many lighting fixtures are involved, this may result in a rather tiring operation for the operator. Therefore, a further embodiment of the invention was developed, which does not require the movement of the adjusting means 30 because all of the power input is along a single axis of power input. Referring now to FIGS. 1 and 2C, the invention is shown embodied in a track lighting system generally designated by the numeral 20, wherein a lighting track 21 supplies power to a track head 22 to which is rotatably mounted a fixture mounting pole 23. If desired, a manual tensioning ring 24 may be added for purposes previously described. Power is supplied from the track head 22 through the power cord 25 to the socket 27 in which is mounted a lamp 26 which is held in a lamp holder, such as gimbal ring 28. It should be understood that each different lamp which is used in the improved lighting fixture of the present invention may require a different "lamp holder". Therefore, this term should be understood in a generic sense to mean any apparatus which is attached to the power transfer means and provides a source of light, whether it is something as simple or simpler than that illustrated in FIGS. 1 and 3, or a complete luminaire, as illustrated in FIGS. 15 and 17. For purposes of illustration only, I have shown the gimbal ring 28. Power can also be supplied through the fixture pole 23, also known in the art as a stem or wand.

The gimbal ring 28 is mounted to the power transfer means 29 in a manner to be more completely described hereinafter. By mounting the power transfer means 29 between the gimbal ring 28 and the fixture mounting pole 23, the light is rotatable about two different axes.

As shown in FIG. 1, an adjustment means 30 may be used to adjust some, or all of the fixtures in the track lighting system. This may be done by maintenance personnel 31 without disturbing any of the display counters 33 on the selling floor 34 of the retail establishment. The customers 32 also remain undisturbed while the fixtures are adjusted by the maintenance personnel without any electrical or burn hazard being presented during the adjustment process.

Figure 3:
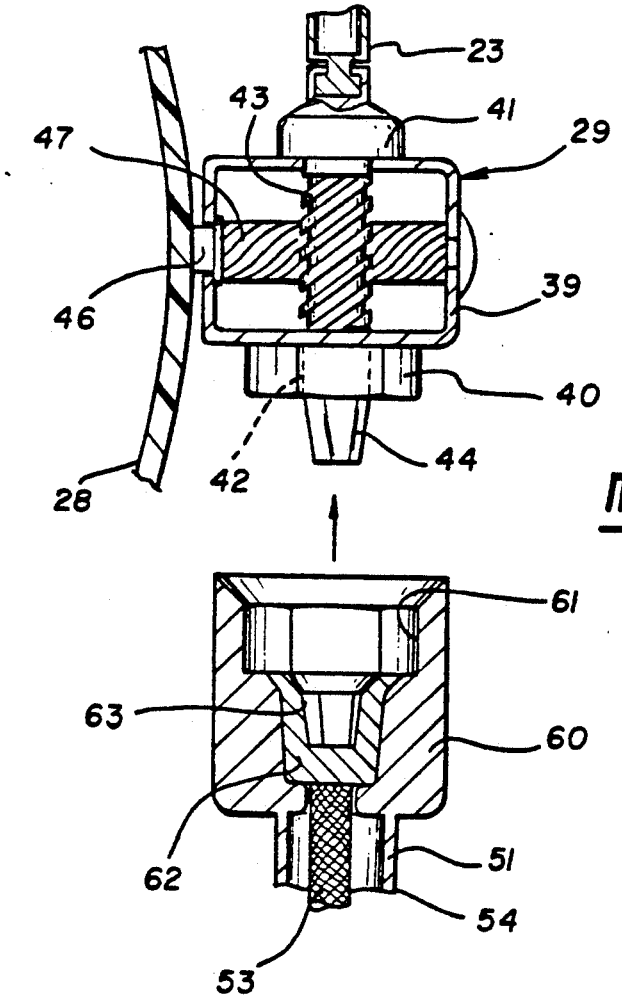
FIG. 3 is a view, partly in section, showing an adjustment means of the present invention which provides for rotation of the lighting fixture about two different axes.
Figure 4:
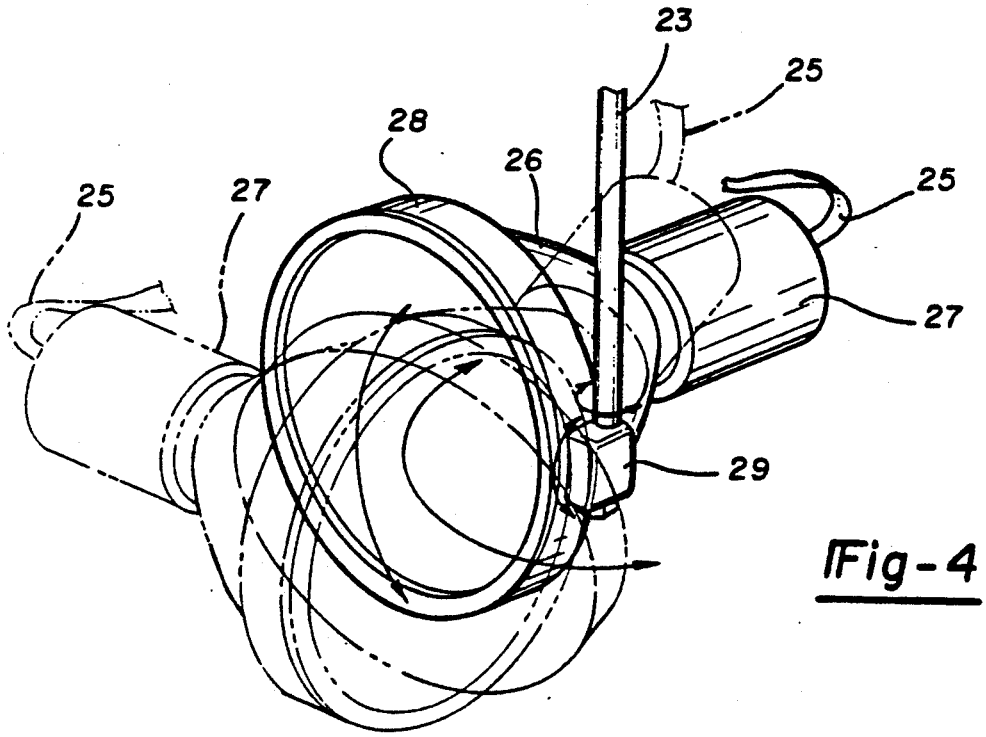
FIG. 4 is a pictorial view showing a portion of the wide variety of adjustments possible in the improved lighting fixture embodying the present invention.

Referring now to FIGS. 3 and 4, there is shown another of the embodiments of the present invention. As shown in FIG. 3, a power transfer means generally designated by the numeral 29 includes a housing portion 39 having a male connector portion 40 formed on the lower end thereof.

It is to be understood that the term power transfer means is used in its broad sense to indicate a transfer of power from one direction to another. While in the this embodiment of the invention the power transfer means is illustrated as a gear box which has an input shaft geared to an output shaft at right angles thereto, the power transfer elements can be other than gears, and the power transfer can take place from one axis to any intersecting axis to have the output shaft of the power transfer means form any practicable angle with the input shaft to give the widest possible variety of options for positioning my improved invention. Also, the power transfer means may be mounted at the end of the adjustment means 30 instead of on the fixture pole 23 as will be hereinafter described. Another embodiment of the invention, the power transfer means will be split between the adjustment means 30 and the end of the fixture mounting pole 23.

Passing through the male connector portion 40 of the housing 39 and rotatably constrained therein is an input shaft 42 having a first worm gear 43 formed thereon and having a male connector 44 formed on the lower end thereof. Also mounted for rotation within the housing 39 is an output shaft 46 fixedly attached to the gimbal ring 28 and having a second worm gear 47 provided thereon. It can be seen that when the input shaft 42 is rotated, the output shaft 46, and therefore the gimbal ring 28, will rotate about the axis of rotation of the output shaft 46, and that when the fixture mounting pole 23, and/or the housing 39 is rotated, the gimbal ring will rotate about the axis of the fixture mounting pole 23.

It should be understood that while I have shown the input shaft and the output shaft being perpendicular to each other, depending upon the desired application, such shafts can be provided at any practicable desired angle to each other to provide rotation about two different axis as desired. Also, while I have assumed for the purposes of description that a conventional track light already has a rotatable mounting pole 23, it is anticipated that in some instances the fixture mounting pole 23 will be fixed to the track head 22, in which case the power transfer means 29 will then need to be rotatably mounted to the fixture mounting pole 23. This is also well within the scope of the present invention.

Also, while I have shown the use of a gimbal ring for mounting a light fixture in the embodiment of the invention shown in FIGS. 3 and 4, as will be described in relation to another preferred embodiment of the invention, the lighting fixture itself, or a portion thereof, may be attached to or be integral with the output shaft of the power transfer means 29, and this is well within the scope of the present invention.

Figure 7:
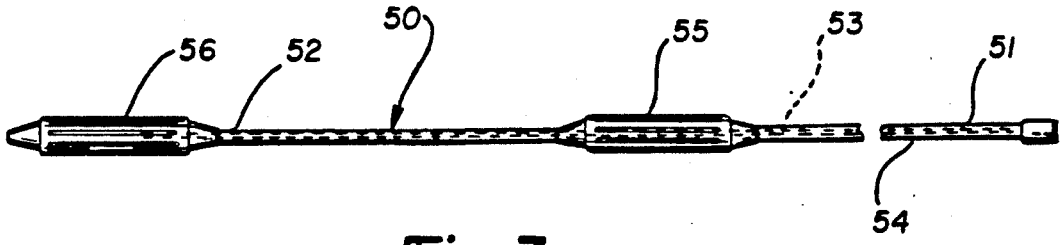
FIG. 7 is an elevational view showing a modification of the adjustment means used in the present invention.

Referring now to. FIGS. 3 and 7, the adjustment means 30 is shown in the form of a wand generally designated by the numeral 50 having an upper end 51 and a lower end 52 and having an inner driving portion 53 and an outer driving portion 54.

Figure 8:
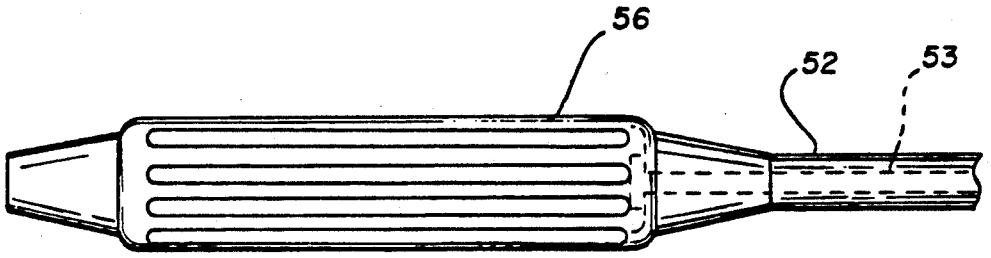
FIG. 8 is an enlarged elevational view of a portion of the adjustment means shown in FIG. 7.
Figure 9:
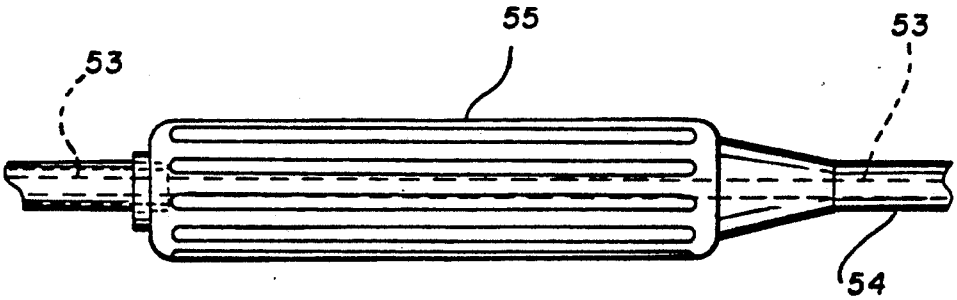
FIG. 9 is an enlarged elevational view showing another portion of the apparatus shown in FIG. 7.

As can be seen by referring to FIGS. 7-9, affixed to the outer driving portion 54 at approximately the midpoint of the wand 50 is an upper handle 55, while at the lower end 52 of the wand 50 there is a lower rotatable handle 56 fixedly mounted to the inner driving portion 53.

Referring again to FIG. 3, it can be seen that at the upper end 51 of the wand 50 there is a first socket 60 fixedly mounted to the outer driving portion 54 of the wand which has a female connector portion 61 formed therein for engagement with the male connector portion 40 of the housing 39.

Rotatably mounted within the first socket 60 is a second socket 62 attached to the inner driving portion 53 of the wand 50 and having a female connector 63 formed therein for engagement with the male connector 44 formed on the lower portion of the input shaft 42. It can be seen that when the lower rotatable handle 56 is rotated while the upper handle 55 is held stationary, only the second socket 62 and therefore the input shaft 42 of the power transfer means rotates, rotating the gimbal ring 28 in a plane which is defined by the ring, and which rotates about the axis of the output shaft 46.

If the lighting axis of the lamp 26 held by the gimbal ring 28 is satisfactory, such lighting axis being through the center of and perpendicular to the plane defined by the gimbal ring, and it is not desired to rotate the gimbal ring, the lower rotatable handle 56 may be held stationary with respect to the upper handle 55, i.e. rotated with the same angular frequency or be constrained to rotate at the same angular frequency with the upper handle 55, in which case the second socket 62 will not rotate with respect to the outer socket 60 so that the drive shaft 42 will not rotate, but the gear box housing 39 will rotate by virtue of its being fixedly connected to the male connector portion 40, thus rotating the gimbal ring about the axis of the fixture mounting pole 23.

In the example shown, the axis of the output shaft 46 about which the gimbal ring rotates, and the axis of the fixture mounting pole 23, are shown to be mutually perpendicular to each other. As hereinbefore mentioned, however, this mutually perpendicular relationship, while being the preferred embodiment, is not the only embodiment possible, and it is well within the scope of the present invention that the two axes of rotation can be at any practicable angle to each other, depending on the particular application desired.

Figure 6:
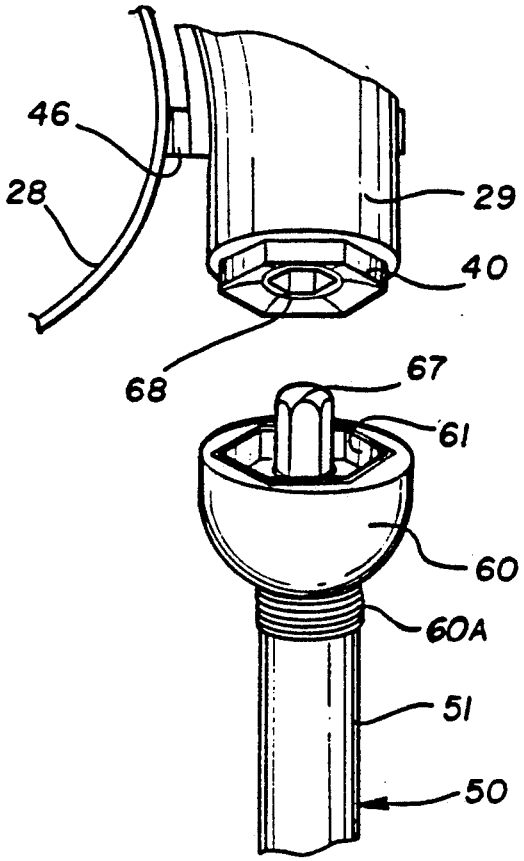
FIG. 6 is similar in part to FIG. 3, showing a modification of the adjustment means of my invention.

Referring now to FIG. 6, next there is shown a modification of the upper end of the wand which has proven desirable when the lighting fixture of the present invention must be adjusted from a great height. In this case, at the upper end 51 of the wand 50, the first socket 60 with the female connector portion 61 is identical to that shown in FIG. 3. However, the male and female connections of the input shaft 42 of the power transfer means 29 are reversed. In this instance, a male connector 67 is fixedly attached to the inner driving portion 52 of the wand 50 and engages a female connector 68 provided at the lower end of said input shaft 42. If desired, the male connector 67 may be spring-loaded for ease of attachment. As before, rotation of the inner driving portion 53 of the wand 50 rotates the gimbal ring 28 in a plane of rotation defined by the ring, which intersects the axis of the output shaft 46, while rotation of the outer driving portion 54 of the wand 50 rotates the gimbal ring in a plane of rotation about the axis of the fixture mounting pole 23. Below the first socket 60 is a flexible joint 60A to allow for ease of engagement by not requiring 0° alignment.

Figure 5:
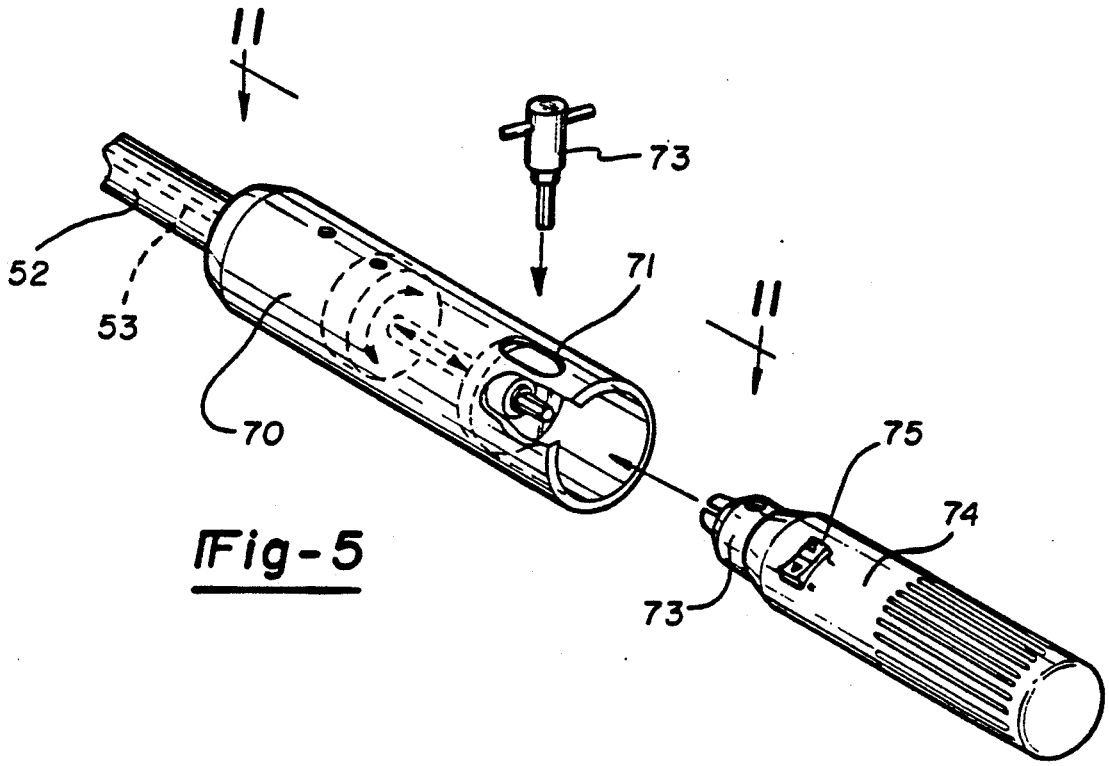
FIG. 5 is a diagrammatic view showing one embodiment of the adjustment means used in the present invention.

Referring now to FIG. 5, where the maintenance personnel of a store have a number of lighting fixtures to adjust, it will be more economical and less tiring for the maintenance personnel to have a power driving means to rotate at least the inner driving portion 53 of the wand 50. In this modification of my invention, the lower rotatable handle 56 is replaced by a housing 70 fixedly mounted to the lower end 52 of the wand 50. A hole 71 is provided in the housing 70 through which a key 72 is passed to tighten the chuck 73 of the driving means provided in the form of an electric motor 74. A switch 75 provided on the electric motor 74 provides that the means to drive said rotatable shaft is reversible.

Figure 10:
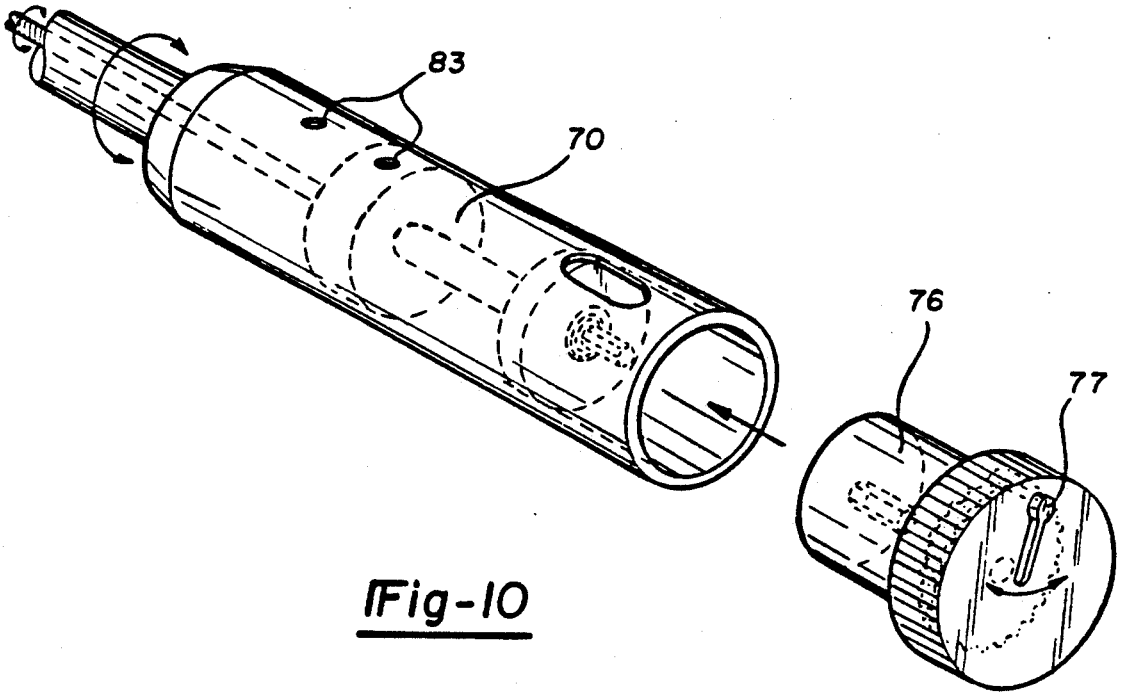
FIG. 10 is a view similar in large part to FIG. 5, but showing a manual drive means.

In FIG. 10, there is shown a modification of my invention where an electric motor 74 is not required, but a more efficient mechanical means is needed to rotate the inner driving portion 53 of the wand 50. In this case, a manual driving means 76 is inserted in the housing 70 in place of the electric motor 74, and the inner driving portion 53 of the wand is driven by ratchet means 77 well known in the art.

Figure 11:
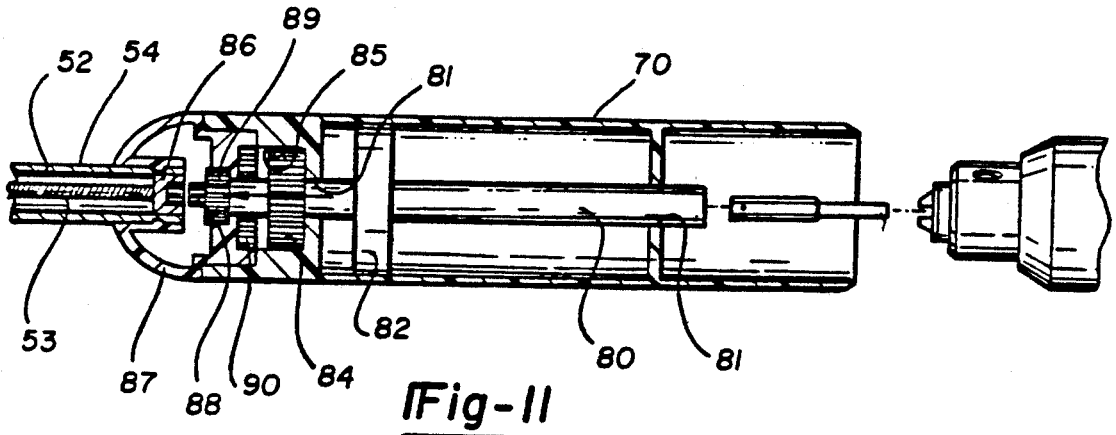
FIG. 11 is an elevational view, partly in section, and similar in large part to FIG. 5 showing the operation of an adjustment means of the present invention.
Figure 12:
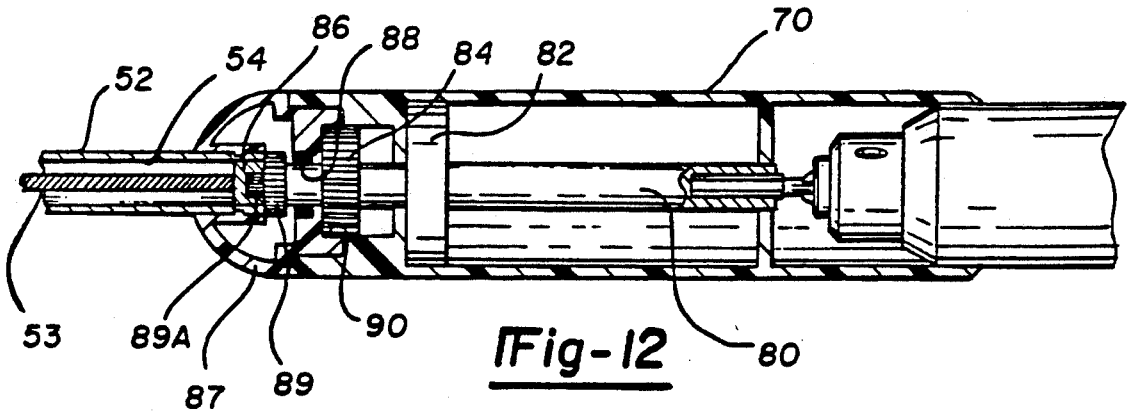
FIG. 12 is a view similar to FIG. 11 showing the rotatable shaft means shifted from its first operating position to its second operating position.

Referring now to FIGS. 11 and 12, the operation of the means to drive said rotatable shaft can be seen in more detail. The housing 70 contains a shaft 80 journaled for rotation therein by means known in the art, and shiftable between a first and second position. The shaft is shown in its first position in FIG. 11, where the means to rotate is set up to rotate the outer driving portion of the wand 50 while holding the inner driving portion stationary, and is shown in its second position in FIG. 12, where the means to rotate is set up to rotate the inner driving portion 53 while holding the outer driving portion 54 stationary.

Referring specifically to FIG. 11, the shaft 80 is journaled for rotation in the housing 70 at bearing surface 81. When shifting between its first and second positions, indicator member 82 will show through one of the holes 83 in the housing 70, as shown in FIG. 10, to indicate to the operator which position the shaft is in. In the first position, a gear 84 rotates within a cavity 85 provided in the housing 70. The lower end 52 of the wand 50 is constructed not unlike the upper end 51 thereof in that the outer driving portion 54 has journaled therewithin an internal spline 86 fixedly attached to the lower end of the inner driving portion 53 which may be flexible as shown. It should also be understood that the outer driving portion 54 which is, in turn, fixedly attached to the drive means 87 can also be flexible. Within the drive means 87 is provided a second internal spline 88 which has teeth which will mate with the second gear 89 when the same is shown in position 1 as shown in FIG. 11.

Opposite the second internal spline is a third internal spline 90 which will mate with teeth from gear 84 when the shaft 80 is in its second position shown in FIG. 12. When the means to rotate is in the position shown in FIG. 11, it can be seen that the gear 84 freely rotates in the cavity 85, while the second gear 89 engages the second internal spline 88, causing rotation of the drive means 87 which is fixedly attached to the outer driving portion 54 of the wand 50. Since there is a loose fit between the internal spline 86 and the outer driving portion 54 of the wand 50, the internal spline 86, and thus the inner driving portion 53 of the wand 50 will not turn, especially since there is some internal resistance involved.

When shifted to position 2, as shown in FIG. 12, the second gear 89 has moved forward to abut against the outer driving portion 54 on the lower end of the wand 52, and the pinion portion **89*a* of gear 89 engages the gear teeth found in the internal spline 86 to rotate the inner driving portion of the wand 50 and therefore ultimately rotate the output shaft of the gear box. Because at the same time the second gear 89 was moved to its forward position the gear 84 also was shifted to engage the third internal spline 90, the drive means 87 is locked to the housing 70 so that the outer driving portion 54 of the wand 50 is held stationary. Of course, it can be seen for this to occur that the gear 84 needs to be suitably attached to the shaft 80 to allow it to shift when said shaft shifts. It must also be freely rotatable about the shaft 80 so that it is not constrained to rotate with the shaft 80**.

Figure 13:
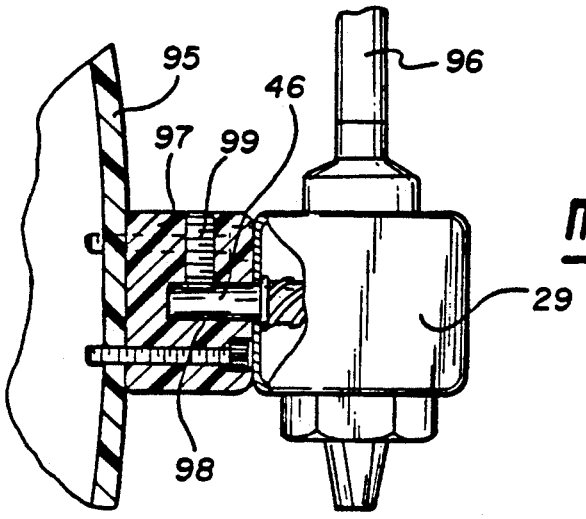
FIG. 13 is a partial elevational view, partly in section, showing a shaft-receiving means attached to an existing lighting fixture to adapt the same according to the method of the present invention to rotate and be adjustable from a remote location.
Figure 14:
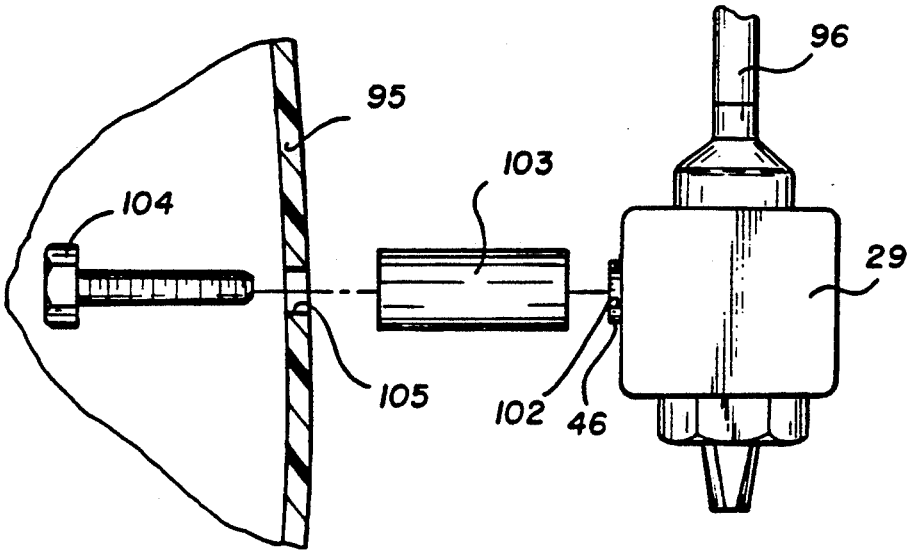
FIG. 14 is a modification of the shaft receiving means shown in FIG. 14.

In connection with developing my unique invention whereby a lighting fixture can be rotated about two different axes from a remote location, I have also developed a novel method of converting existing lighting fixtures to use my apparatus. Many spotlights are offered for use in connection with track lighting or other types of lighting apparatus. Referring to FIGS. 13 and 14, many of them have a fixture housing such as indicated by the numeral 95 mountable to some sort of a fixture mounting pole 96. If the lighting fixture to be adapted is similar to that shown in FIG. 2, my method involves disconnecting the lighting fixture from the fixture mounting pole 96, attaching a power transfer means 29 of the type previously described to the bottom of the fixture mounting pole 96, attaching a shaft-receiving means 97 having a shaft-receiving hole 98 provided therein, and placing the output shaft 46 into the shaft-receiving hole 98 and tightening the set screw 99, thereby locking the light fixture to the gear box 29. Thereafter, the operation of the pre-existing lighting fixture becomes the same as my improved lighting fixture.

In some cases, the conversion shown in FIG. 14 is more convenient. In this case, the power transfer means 29 is still attached to the fixture mounting pole 96, but the output shaft 46 thereof has an internal thread 102 provided therein. A spacer 103 is provided between the fixture housing 95 and the fixture mounting pole 96, and a bolt 104 or other suitable means is placed through the hole 105 and the spacer 103 into the internally threaded portion 102 of the output shaft 46 of the power transfer means 29.

If the fixture mounting pole is not sufficiently similar to the one illustrated in FIG. 1, it may be necessary to replace the old fixture mounting pole with a new fixture mounting pole having a power transfer means mounted on the lower end thereof, and then attaching the shaft-receiving means to the lighting fixture, and connecting the output shaft of the power transfer means to the shaft-receiving means to accomplish my conversion.

In some cases, the spotlights, instead of having a single point of connection between the lighting fixture and the pole, have a yoke-type mounting arrangement, and if this type of lighting fixture is to be converted, it is necessary to disconnect the lighting fixture entirely from the fixture mounting pole, discarding the yoke and interposing between the portion of the fixture mounting pole remaining and the lighting fixture a power transfer means 29 of the type previously described in order to accomplish the method of the present invention. By either simply mounting a gear box to the lower end of a fixture mounting pole, replacing the fixture mounting pole with a fixture mounting pole of the type described, or interposing a power transfer means such as a gear box, it is believed that a majority of the lighting fixtures may be converted, using my method, to light fixtures adjustable in accordance with the present invention, thus saving thousands of dollars in many instances over the cost of providing entirely new light fixtures operating according to the present invention.

Referring now to FIG. 15, there is shown a modification of the present invention wherein the power transfer means 29 is mounted at the upper end of the wand 50 instead of on the lower end of the fixture mounting pole 23. In this modification, the output from the power output means 29 is transferred to a male connector 107 which fits into a female connector 108 which is fixedly connected to fixture housing 109 to rotate the same upon rotation of the inner driving portion 53 (not shown) of the wand 50. Rotation of the outer driving portion 54 of the wand 50 will cause the fixture housing 109 and/or the fixture mounting pole 23 to rotate. As before, the power transfer means 29 may be integral with, or attached to, the end of the wand 50.

Figure 16:
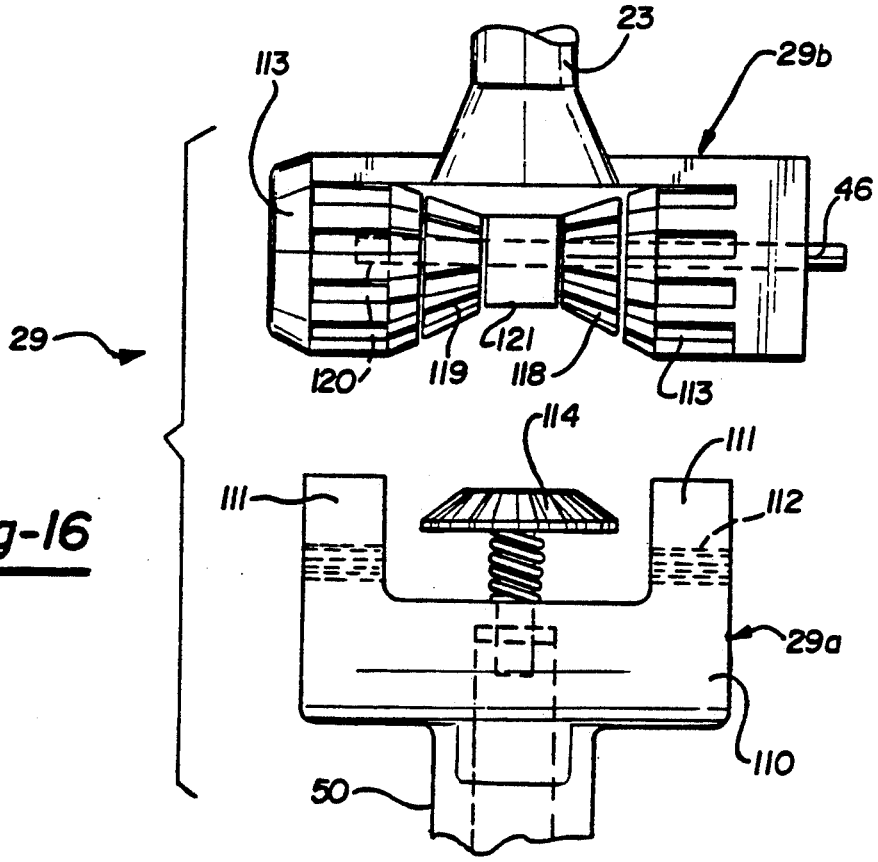
FIG. 16 is an elevational view showing a further modification of the invention where a portion of the power transfer means are placed at the end of the fixture mounting pole and a portion of the power transfer means are placed at the end of the hollow adjustment wand.
Figure 18:
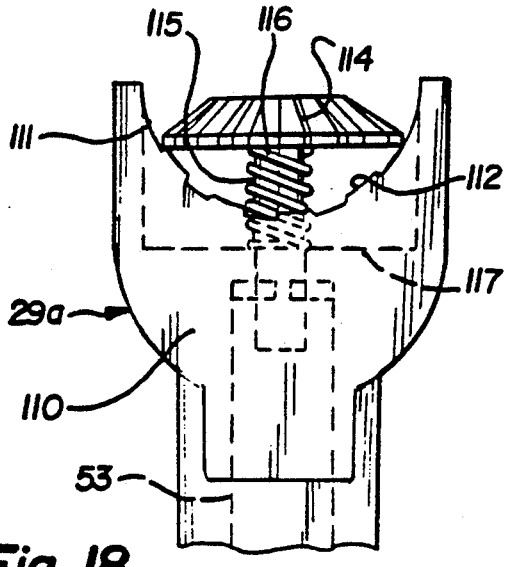
FIG. 18 is an end view of the top portion of the hollow adjustment wand shown in FIG. 17.

Referring now to FIGS. 16–18, there are shown other embodiments of the present invention. In the embodiment shown in FIGS. 16, 17 and 18, the power transfer means 29 is split into more than one part, in this specific instance, two parts, so that the power transfer means 29 has a power input portion 29A and a power output portion 29B. The power input portion 29A of the power transfer means 29 is mounted to, or integral with, the upper end of the wand 50, while the power output portion 29B is mounted to, or integral with, the lower end of the fixture mounting pole 23. The power input portion 29A of the power transfer means 29 further includes a bifurcated member 110 having a pair of identical cradles 111 at each end thereof. Each cradle has a series of axially spaced ribs 112 which mate with corresponding recesses in the cradle receiver 113 of the power output portion 29B.

Mounted for rotation between the cradles 111 is a bevel gear 114. The bevel gear 114 is mounted to the upper end of stub shaft 115 and spring loaded by the spring 116 which abuts against the floor 117 of the power input portion 29A. The lower end of the stub shaft 115 is splined or otherwise restrained for rotation and reciprocation by means well known in the art to the upper end of the inner driving portion 53 of the wand 50. As before, the bifurcated member 110 may be mounted to or integral with the wand 50.

The power output portion 29B of the power transfer means includes the cradle receiver 113 which is complementary in shape to at least a portion of the bifurcated member 110 to receive the ribs 112 which are radially spaced in the cradles 111. The bevel gear 114 drives a second bevel gear 118 attached to output shaft 46. Bevel gear 114 also drives an idler gear 119 mounted for rotation to idler shaft 120, which is supported, in part by bushing 121. Thus, when the power input portion 29A of the power transfer means 29 is moved into the engagement with the power output portion 29B, the bevel gear 114 engages second bevel gear 118 to rotate output shaft 46 when the inner driving portion 53 of the wand 50 is rotated, thereby rotating the luminaire 120 about said second axis of rotation.

Rotation of the outer driving portion 54 of the wand 50 rotates the luminaire 120 about a said first axis of rotation by virtue of the rotation of the fixture mounting pole 23. As with the other modifications of the present invention previously described, the power output portion 29B of the power transfer means may be integral with the fixture mounting pole 23 as shown in FIG. 17, in which case the fixture mounting pole 23 will be rotatably mounted in the track head 22. Depending on the application, in some installations, the fixture mounting pole 23 may be fixedly mounted to the track head 22 in which case, the power output portion 29B will not be integral with the fixture mounting pole 23, but instead, will rotate with respect thereto. As before, the fixture mounting pole may also be mounted directly to a canopy (not shown) instead of a track head.

Figure 17A:
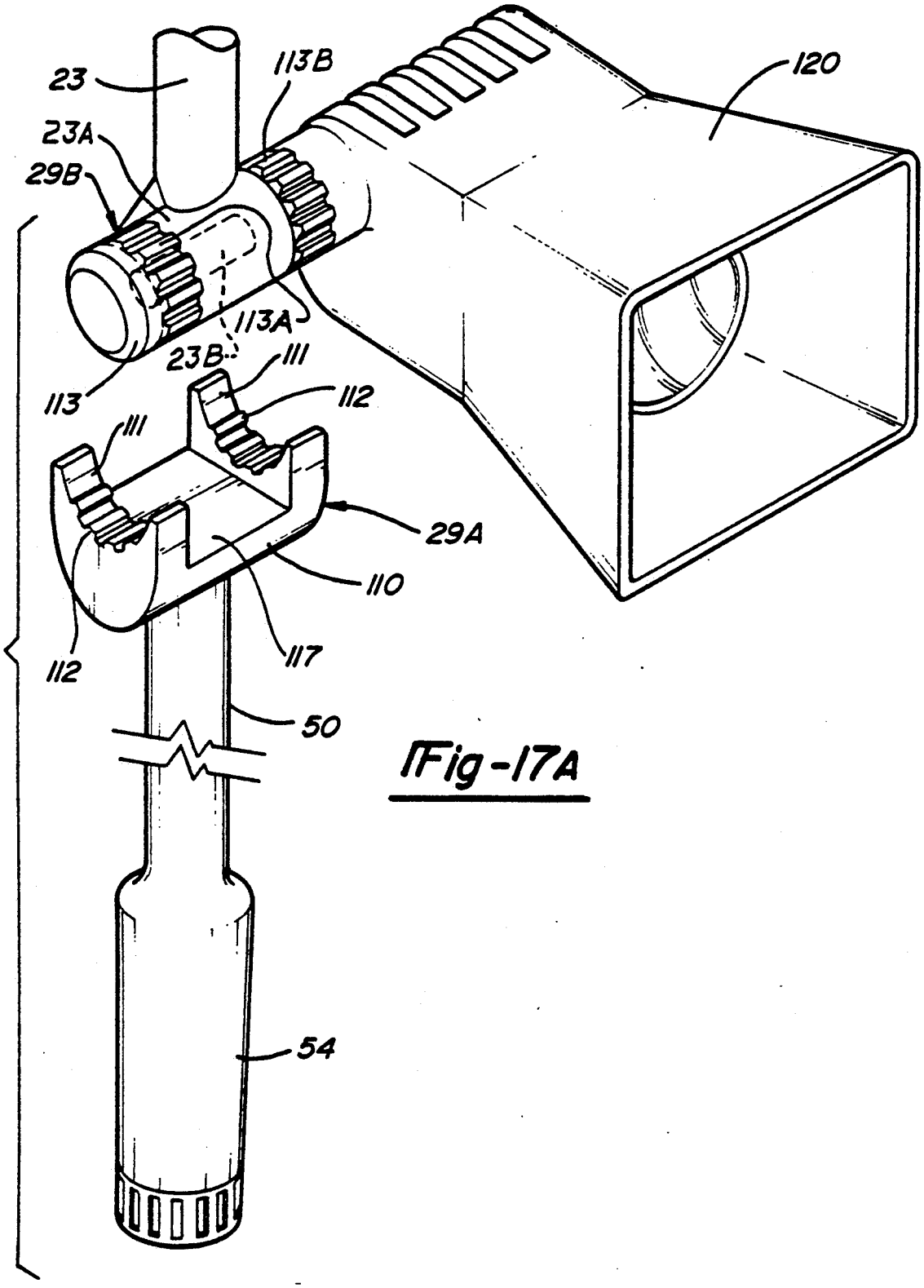
FIG. 17A is a modification of the construction shown in FIG. 17.

Referring now to FIG. 17A, there is shown an embodiment of the present invention wherein the power transfer means 29 is also split into more than one part. Again, it is split into two parts, so that the power transfer means 29 has a power input portion 29A and a power output portion 29B. The power input portion 29A of the power transfer means 29 is again mounted to, or integral with, the upper end of the wand 50. The power output portion 29B is again mounted to, or integral with, the lower end of the fixture mounting pole 23. The power input portion 29A of the power transfer means 29 in this embodiment of the invention again further includes a bifurcated member 110 having a pair of identical cradles 111 at each end thereof. Each cradle has a series of axially spaced ribs 112 which mate with corresponding recesses or teeth in cradle receiver 113.

In this embodiment of the invention, it can be seen that the power input portion 29B of the power transfer means 29 has been substantially modified. In this case, the lower end of the fixture mounting pole 23 has mounted to or integral therewith a bushing portion 23A in which is journaled for rotation a shaft 23B. At each end of the shaft 23B is mounted a cradle receiving gear (113A, 113B) with the second cradle receiving gear 113B being integral with or fixedly mounted to the luminare 120. It can be seen in this embodiment of the invention that a solid wand 50 can be used, as there is no longer any need for the bevel gear 114, the stub shaft 115, spring 116, or inner driving portion 53 of the wand 50. To operate this modification of the invention, a simple rotation of the wand 50 about its own axis will cause rotation of the fixture pole 23 (and the luminare 120) about its own axis (first axis of rotation) and a movement of the wand 50 fore or aft by the operator will cause a rotation of the shaft 23B about its own axis or second axis of rotation. This modification of the invention has proved to be advantageous when infrequent adjustment of the lighting fixtures is contemplated.

Referring now to FIGS. 19-27 there are shown embodiments of the present invention wherein the axis of power input is offset from one of the two axes of rotation. For ease of understanding these embodiments of the invention some explanation of terminology is desirable. It will be seen that all of the power input is still along one axis, as in the prior embodiment, but it now takes two forms. There is either a rotational input about the single, offset, axis of power input, i.e. the rotation of a power input means or shaft about its own axis, or there is an orbital input about the single, offset, axis of power input, or in other words, there is an orbiting of a power input means or shaft about a first axis of rotation. The first axis of rotation is the axis which the single, offset, axis of power input is offset from.

Referring now to FIGS. 19-25, there is shown an embodiment of the present invention similar to that shown, for example, in FIGS. 1-4 but where there is a single, offset, axis of power input, as distinguished from a power input which is in line with the mounting pole 23.

For ease of illustration it will be assumed that the fixture mounting pole 23 is rotatably mounted to a track head (not shown). In such an embodiment, the power transfer means 29 would be fixedly mounted to the fixture mounting pole 23. It can be seen that the fixture mounting pole 23 may also be stationary, and the power transfer means 29 may be rotatably mounted thereto, and this construction would be well within the scope of the present invention. The power transfer means, generally designated by the numeral 29, includes a housing portion 39 having an offset power input shaft 150 on which is formed worm 150A. Worm 150A drives worm gear 152 fixedly attached to the end 151A of enlarged power output shaft 151. Attached to the end of the offset power input means or shaft 150 is the lamp holder 153.

Lamp holder 153 depending on the particular application may have lamp socket 154 electrically connected to a power source (not shown) which holds a lamp 155.

As in the previous embodiment, it is to be understood that the term "power transfer means" is used in its broad sense to indicate a transfer of power from one direction to another. While in this embodiment of the invention the power transfer means is illustrated as a gear box which has an offset input shaft 150 geared to an output shaft 151 at right angles thereto, the power transfer elements can be other than gears. The power transfer can take place from one axis to any intersecting axis, to have the output shaft of the power transfer means form any practicable angle with the input shaft. This gives the widest variety of possible options for positioning the lamp holder of the present invention.

To rotate the offset power input means or shaft 150 it is necessary to make a connection to the female connector portion 157 of a knob 156. For this purpose there is provided solid or unitary adjustment means 158 having a wand portion, which may be telescoping, such as the telescoping wand portion 159 and a connector portion 160. The connector 160 has an internal threaded portion 161 to accept a screw thread 162 provided on the end of the telescoping wand portion 159. The upper end 163 of connector 160 has a tapered portion 164 with a like shaped tapered recess 165 provided therein into which the driver 166 is operatively mounted. The driver 166 has on its lower end a hexagonal shaft 167 which fits into hexagonal recess 168 in connector 160. The hexagonal shaft 167 is held in place within hexagonal recess 168 by the set screw 170. A set screw 170 is also used to hold the knob 156 to the worm gear 152. Because of the use of the knob 156 and the driver 166 in the present invention, the connector 160 of the adjustment means 158 may be presented to the offset power input means or shaft 150 of the power transfer means 29 at an angle of up to 25 degrees off center, and a connection still be made.

For purposes of description of the invention, it will be assumed that the solid or unitary adjustment means 158 is connected to the knob 156 on a vertical axis. It can be seen that if the adjustment means 158 is held stationary, since the axis of power input is offset from the first axis of rotation formed by the fixture pole 23, moving or orbiting the adjustment means 158 in a circle about the fixture pole 23 causes the fixture pole 23 to rotate about its axis, which is the first axis of rotation of the lamp holder 153.

Rotation of the adjustment means 158 about its own axis (the axis of power input) causes rotation of the offset power input shaft or means 150, which in turn rotates worm gear 152 and enlarged power output shaft 151 about the second axis of rotation. Attached to the output shaft 151 is the lamp holder 153 which will now rotate about a second axis of rotation. Thus, it can be seen that by mounting the power transfer means 29 between the lamp holder 153 and the fixture mounting pole 23, the lamp holder 153 is rotatable about two different axes of rotation in response to a power input along a single axis offset from one of said axes of rotation.

Figure 22:
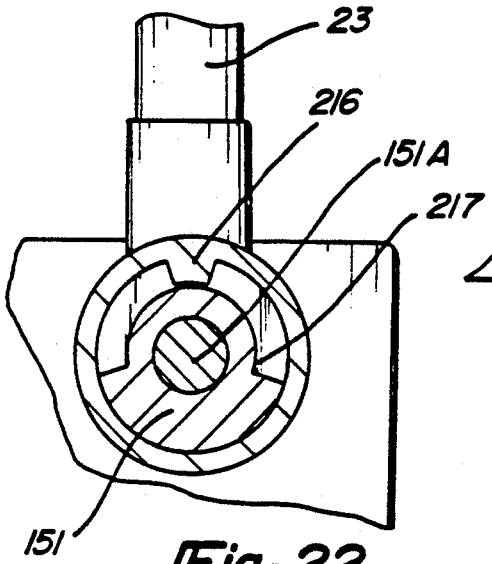
FIG. 22 is a sectional view, taken in the direction of the arrows, along the section line 22—22 of FIG. 21.
Figure 21:
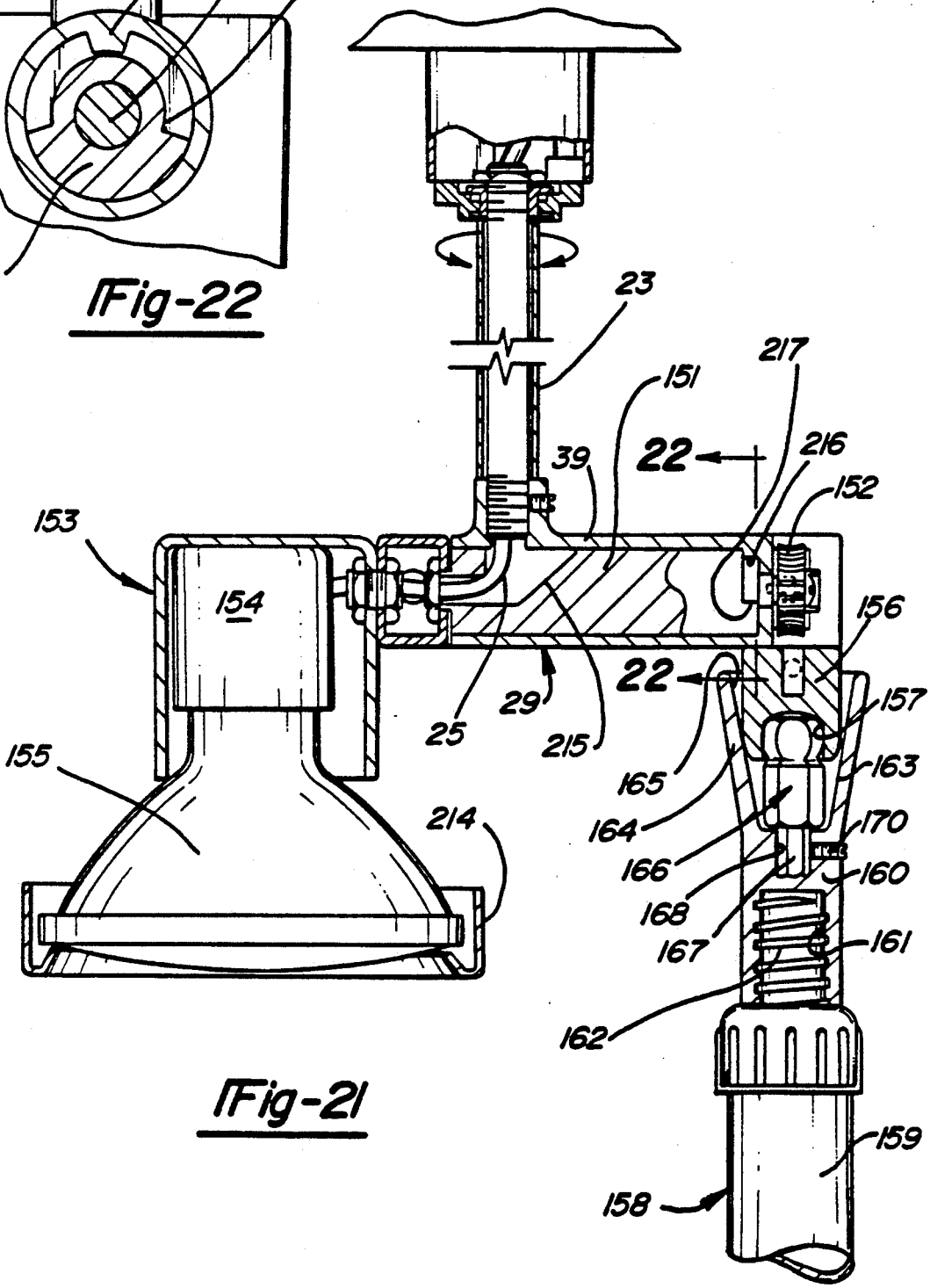
FIG. 21 is an elevational view, partly in section, of the construction shown in FIG. 20.

Referring now to FIG. 22, it can be seen that a boss 216 provided on a portion of the interior of the power transfer means 29 cooperates with a semi-circular recess 217 provided at one end of the enlarged power output shaft 151 to limit the amount of rotation of said shaft. In modifications where it is desired that the power cord 25 pass through the fixture pole 23, a recess or cutout 215 is provided in the power output shaft 151. Where desired, a lamp protector or protective ring 214 may be provided.

It can be seen that all the power input to the lighting system in this modification of the invention is through a single node or point of power input proximate the intersection of the offset axis of power input and the second axis of rotation. A rotational input to said node causes rotation of the light fixture about the second axis of rotation, while an orbital input to said node, which involves a force substantially tangential to the first axis of rotation and substantially perpendicular to said offset axis of power input, produces rotation about the first axis of rotation.

Figure 23:
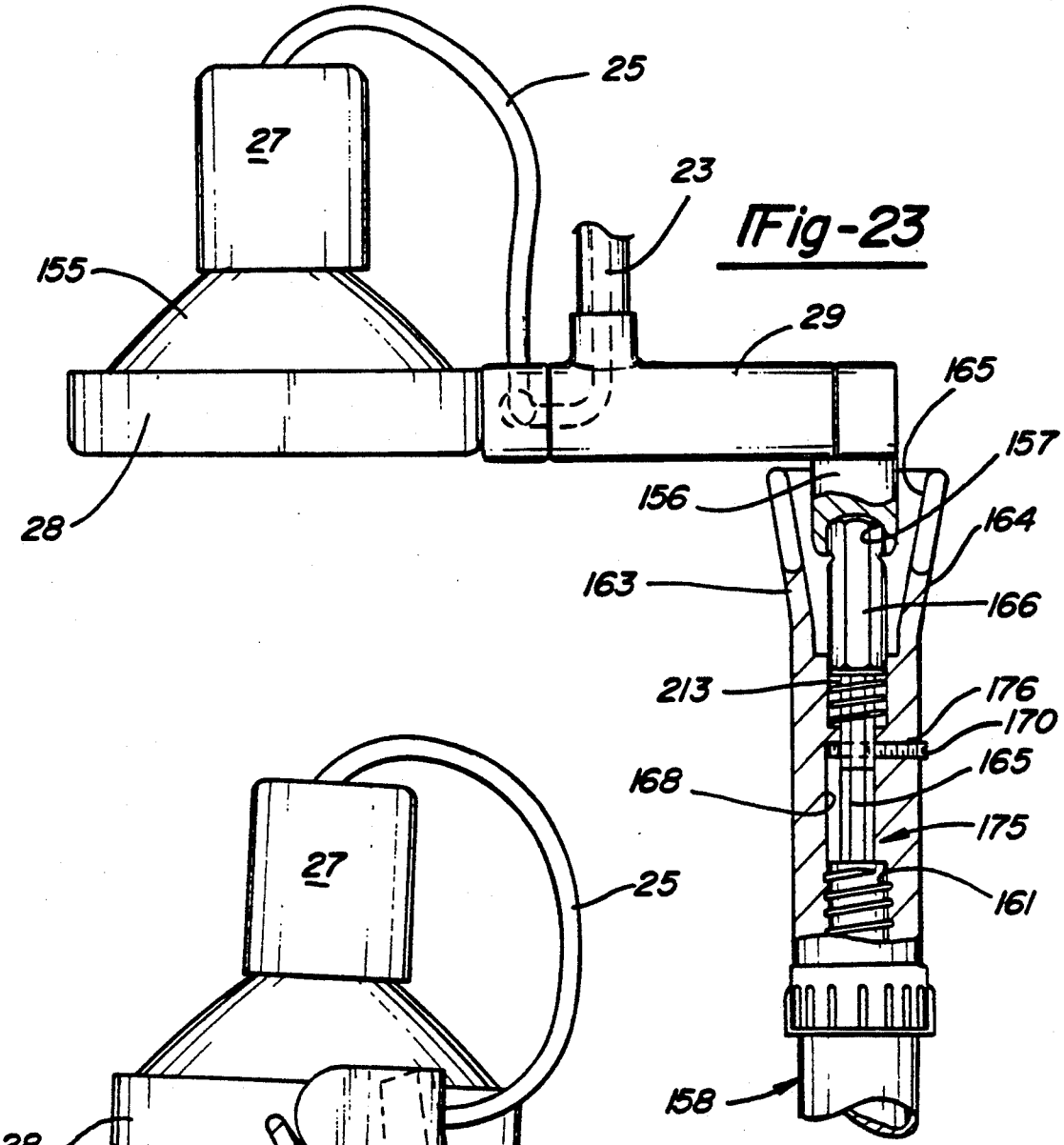
FIG. 23 is a view similar to FIG. 21 but showing the use of a spring loaded wand with a cutout.
Figure 24:
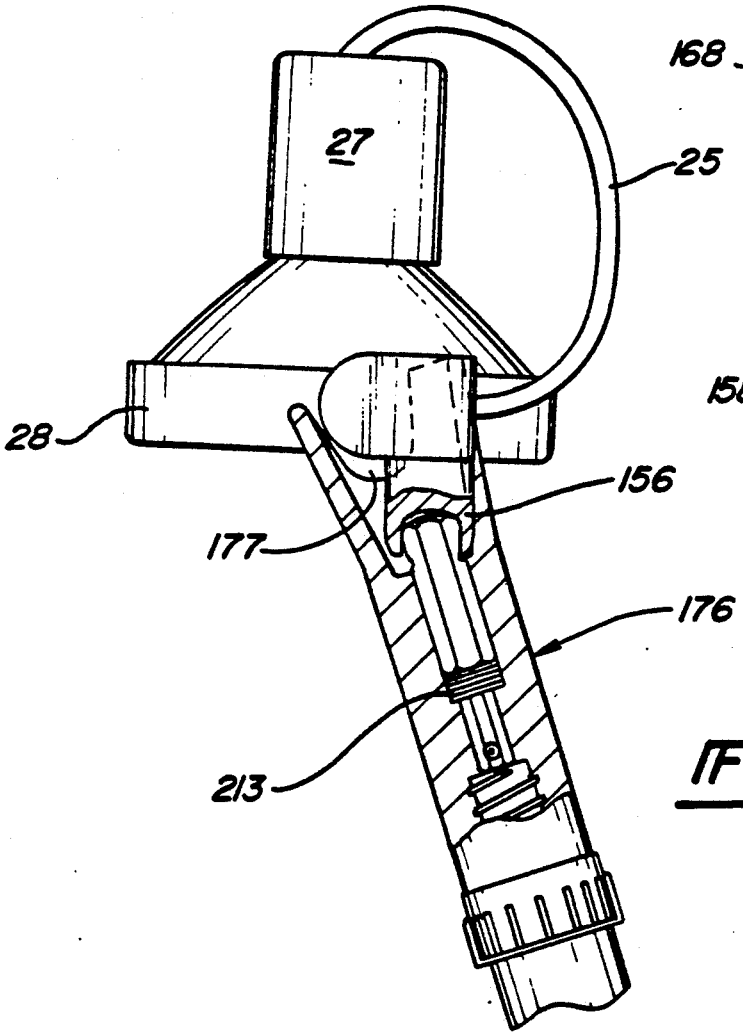
FIG. 24 is an end view, partly in section, of the construction shown in FIG. 23.

Referring now to FIGS. 23 and 24, there is shown a modified connector 175. As before there is a hexagonal recess 168 to receive the like shaped hexagonal shaft 167 on the driver 166. A threaded opening 176 accepts the set screw 170 used to set the hexagonal shaft 165. The internal thread 161 is provided as before for attachment to the adjustment means 158 by way of screw thread 162. The upper end 163 of the connector 175 is tapered as before, and the like shaped tapered recess 165, is again provided. In this modification, however, a at least one scallop or recess 177 is provided about the upper extremity of the tapered portion 163 for engagement with power transfer means 29 upon applying upward pressure to the adjustment means 158. This will cause the driver 166, which in this modification has a slip fit with the hexagonal shaft 177, to travel downward until the spring 213 is compressed substantially to the maximum extent possible. This allows the recess 177 in the modified connector 176 to at least partially surround the power transfer means 29 and aid in the rotation of the power transfer means about the first or fixture pole axis of rotation by an orbital power input through the adjustment means 158 operating on the knob 156. Also shown in this modification is the use of a gimbal ring 28 to hold the lamp 155. The power cord 25 transmits power to the socket 27 similar to the modification of the invention shown in FIGS. 1 and 2.

Figure 25:
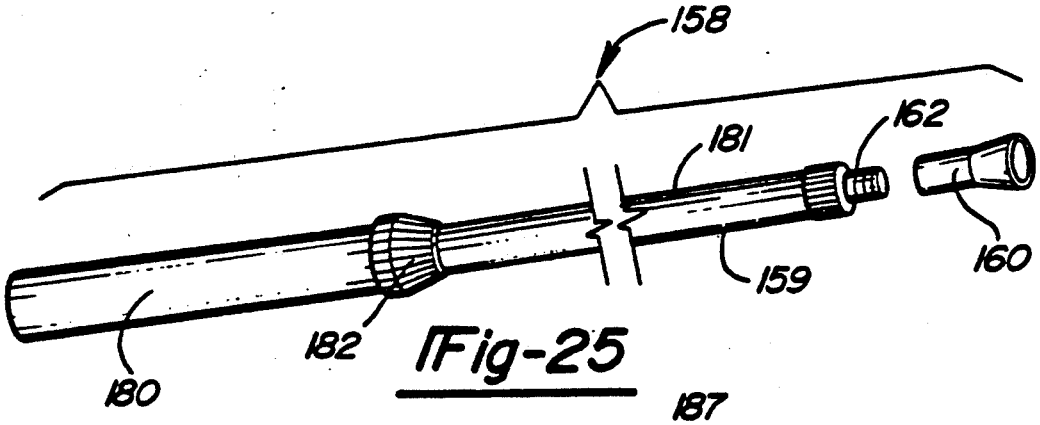
FIG. 25 is a perspective view of the telescoping adjustment wand used with the adjustment means of FIG. 19.

Referring now to FIG. 25, the solid adjustment means 158 used is shown. The solid adjustment means 158 takes the form of a telescoping wand 159 having an outer portion or pole 180 preferably made out of aluminum, inside which is slidably mounted an inner portion or pole 181 preferably made out of fiberglass. An adjustment nut 182 tightens or bears down on the inner portion 181 after it is adjusted to a desired position to prevent it slipping with regard to the outer pole or portion 180. As previously described the screw thread 162 screws into connector 160.

Solid or unitary telescoping wands of the above type are well known in the art. The wand used in the present invention may be such as Model No. 6512 manufactured by Mr. Longarm, Inc. of Greenwood, Miss.

Figure 26:
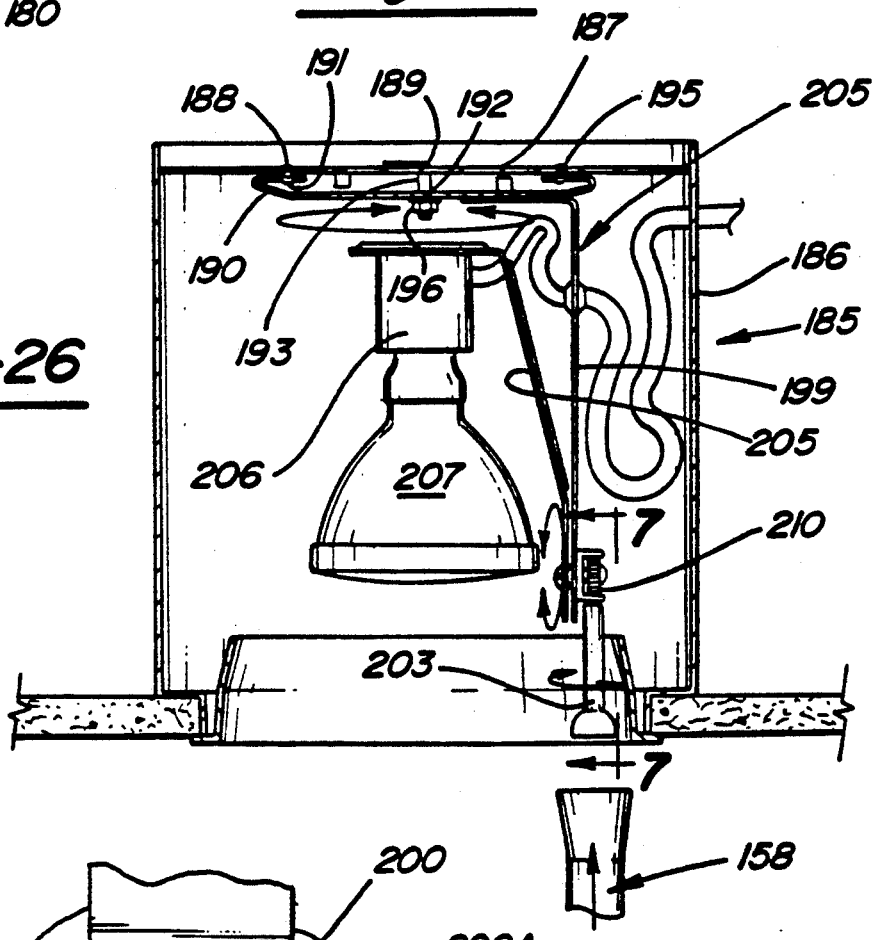
FIG. 26 is an elevational view, partly in section, of a further modification of the present invention wherein a recessed lighting fixture is provided with the axis of power input being offset from one of the axes of rotation.
Figure 27:
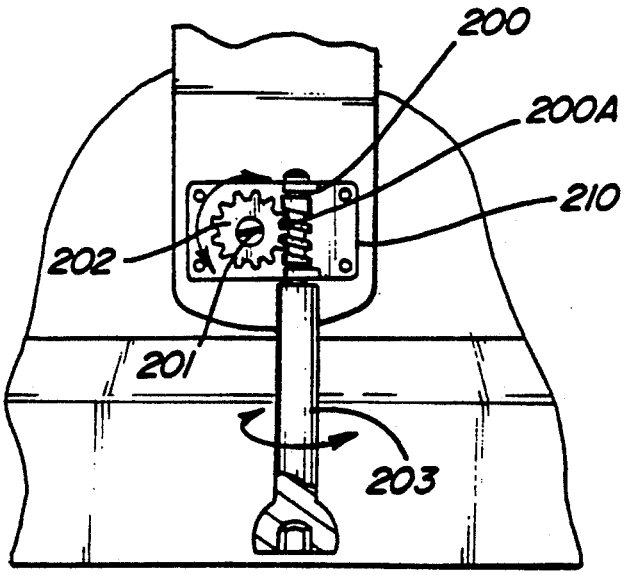
FIG. 27 is a partial, enlarged, elevational view of the power transfer means used in the construction of FIG. 26.

Referring now to FIGS. 26–27 the principal of having an offset axis of power input has been applied to a novel recessed lighting fixture. Recessed lighting fixtures are well known in the art, such as the Omega 19177 fixture. In the preferred embodiment of this modification of my invention a recessed lighting fixture, generally designated by the numeral 185 is provided which may utilize the housing 186 from the aforementioned Omega 19177 recessed lighting fixture. A modified top wall 187 is provided in the housing 186 which has a first bearing race 188 provided therein. The top wall 187 also has an opening 189 therein for purposes to be hereinafter described.

A spun bearing base or platform 190 which may have second, opposing bearing race 191 is provided. It has a central opening 192 through which threaded angle shaft 193 passes. Since the threaded angle shaft 193 is L-shaped, it will not pass completely through the opening 189 in top wall 187. Ball bearings 195 are interposed between the top wall 187 and the spun bearing base 190, and the nut 196 is placed on the threaded portion of angle shaft 193 and tightened to a predetermined degree. This provides the desired resistance to rotation or friction between the spun bearing base 190 and the top wall 187. In this embodiment of my invention, it can be seen that the first axis of rotation will be on an axis passing vertically through a portion of the shaft 193.

Figure 19:
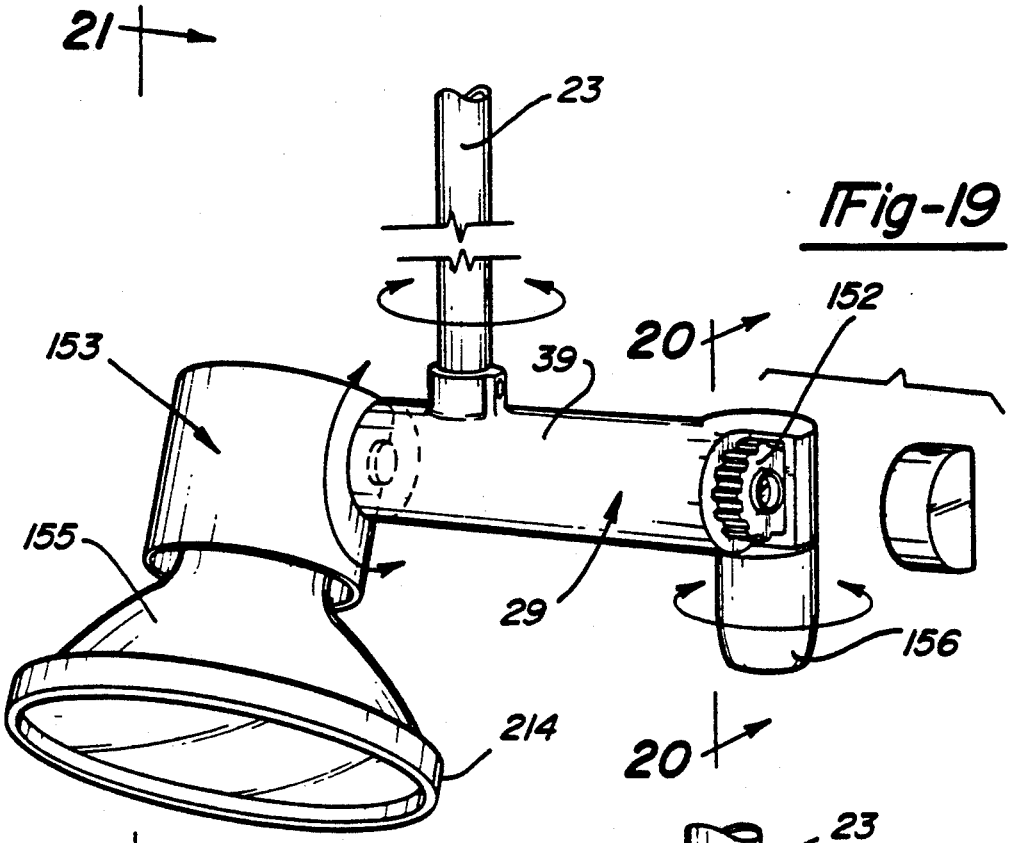
FIG. 19 is a partial perspective view showing a modification of the present invention wherein the axis of power input is offset from one of the axes of rotation.
Figure 20:
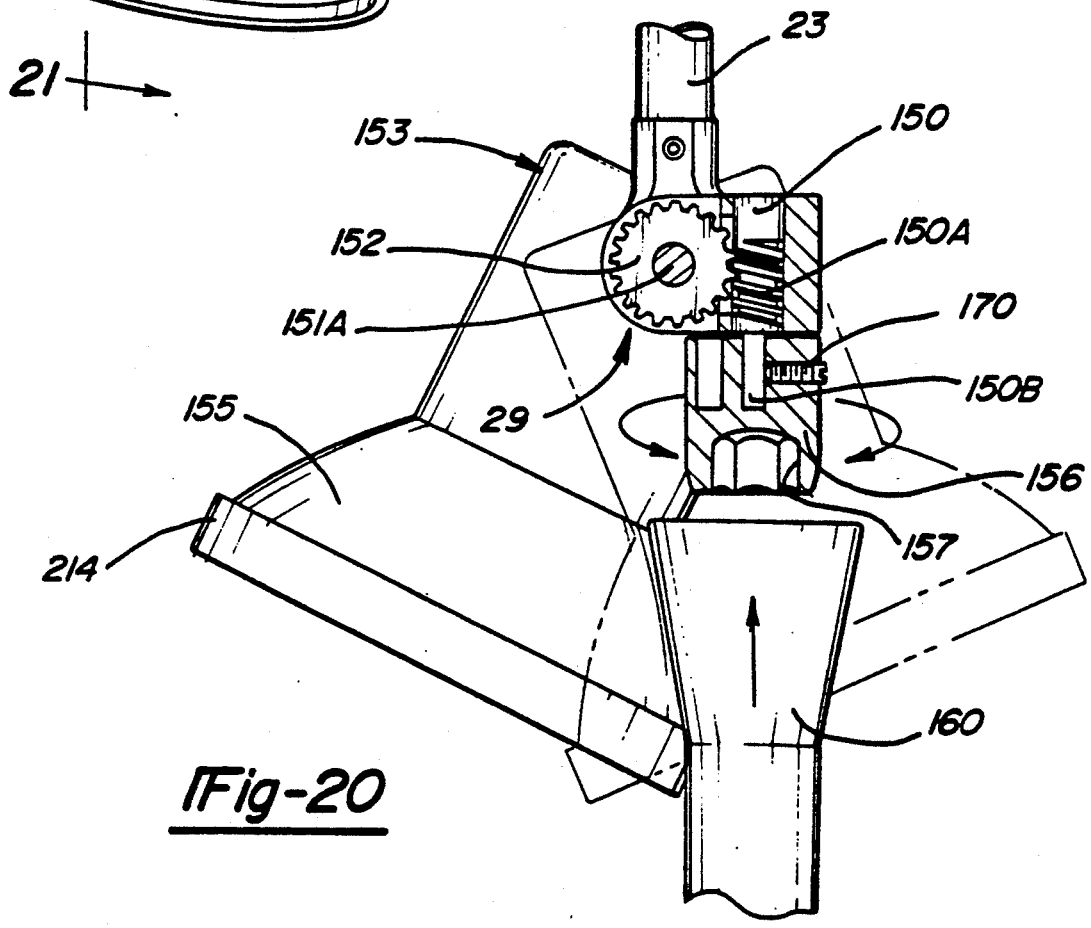
FIG. 20 is an end view, partly in section, of the construction shown in FIG. 19.

The power transfer means in this embodiment of the invention, generally designated by the numeral 210, roughly corresponds to the power transfer means 29 shown in FIG. 19. The L-shaped shaft 193 may be said to correspond to the fixture mounting pole 23, while the spun bearing base 190 and the L-shaped mounting bracket 199 provide the offset provided by the housing 39. To complete the power transfer means 210, a gearbox or other device is mounted to the L-shaped arm 199, preferably at the lower end thereof. Gearbox 211 includes input shaft 200 with worm 200A formed thereon, and output shaft 201 having gear 202 fixedly mounted thereto. The power output means 201 is at a right angle to the power input means 200, but, as can be understood by one skilled in the art, any practical angle may be formed between the power input means and the power output means. Also, it can be seen that the larger the offset provided by the power transfer means, the smoother the rotation will be.

Mounted to the power input shaft 200 is an elongated ball knob 203 which may be driven by the adjustment means 158 previously described. Fixedly mounted to the power output shaft 201 is the lamp bracket 205. To lamp bracket 205 is mounted lamp holder 206 which holds, by means well known in the art, the lamp 207. The operation of the recessed lighting fixture 185 provided in this modification of the invention is substantially similar to the operation of the offset drive lighting fixture previously described.

Rotation of the elongated ball knob 203 about its own axis will result in rotation of the power output shaft 201 attached to the lamp bracket 205, thus resulting in the lamp 207 rotating about the axis of the power output shaft 201, or about the second or horizontal axis of rotation. The rotation or orbiting of the adjustment means about the first axis of rotation (the vertical axis passing through the opening 189) provides rotation of the lamp about the first axis of rotation.

The rotation about the threaded shaft 193 is a rotation of the lamp about a first axis of rotation. The rotation of the lamp about the power output shaft 201 is a rotation of the lamp about a second axis of rotation. These are both provided by a single axis of power input to the power transfer means 29, said axis of power input being offset from one of said axes of rotation, in this case said first axis of rotation.

Various mechanisms may be used to effect the rotation of the lamp bracket 205 about the second axis of rotation and be well within the scope of the present invention. While a gearbox is preferred because it automatically provides a drag in the adjustment process to guard against the possibility of slippage, many devices such as u-joints, rack and pinion gears, knee action devices and other devices may be used and be well within the scope of the present invention. Such devices may directly connect the lamp bracket to the power output shaft 201, or the lamp bracket 205 could be fixedly mounted to the power transfer means 210 and a series of levers or other linkages could cause rotation of an appropriately mounted lamp socket 206, as long as a power input about a single offset axis of power input causes rotation of the lamp 207 about two axes of power output.

In this modification of the present invention, as in the previously described modifications of the invention, the axis of power input can be in a horizontal or vertical direction. Also the single axis of power input does not have to be at a right angle with the axis of power output but instead they may be at any practicable angle.

The power transfer means 29 connected to the fixture mounting pole, whether providing for an in-line or offset axis of power input, and primarily intended for use with exposed lighting fixtures, and the platform type power transfer means, intended primarily for use in recessed lamp applications, taken together can comprise an adjustable lighting system in which all the lighting fixtures can be adjusted by the same adjustment means.

Thus, by carefully analyzing the longstanding problems in the lighting art, and determining that by providing a gear box or other power transfer means between the common fixture mounting pole and the lighting fixture itself, that rotation about a first and second axis of rotation could be achieved from a remote location, I have provided a novel and more efficient lighting system, providing for easy adjustment of any luminaire used in the system.

I claim:

1. A lighting system including in combination:

(a) a power transfer means having a single axis of power input and two axes of power output, one of said two axes of power output being offset from said single axis of power input, said power transfer means having an output shaft rotatable in response to rotation of a distinct power input shaft, and (b) a light source connected to said power transfer means for rotation about each of said two axes of power output in response to a rotation of a power input means about said single axis of power output.

2. An adjustable lighting system, including in combination:

(a) a power transfer means having a power input means offset from a first axis of rotation, said power transfer means also including an output shaft rotatable in response to rotation of a distinct input shaft and having a housing connected to a fixture mounting pole, and (b) a light source connected to said power transfer means to rotate about said first axis and a second axis of rotation in response to rotational power input to said offset power input means.

3. In an adjustable lighting system:

(a) a power transfer means having offset power input means arranged parallel to but offset from a first axis of rotation, and power output means arranged along said first axis of rotation and a second axis of rotation, said power transfer means further including an output shaft coaxial with said second axis of rotation and a distinct input shaft arranged parallel to said first axis of rotation, and (b) a light source connected to said power transfer means to rotate about said first and said second axis of rotation in response to a power input to said offset power input means.

4. An adjustable lighting fixture including, in combination:

(a) a power transfer means having offset power input means arranged parallel to but offset from a first axis of rotation, and power output means arranged along said first axis of rotation and a second axis of rotation, and (b) a light source connected to said power transfer means to rotate about said first and said second axis of rotation in response to a power input to said power transfer means about said first axis of rotation only.

5. In an adjustable lighting system including recessed adjustable fixtures:

(a) a power transfer means having offset power input means arranged parallel to but offset from a first axis of rotation, and power output means arranged along said first axis of rotation and a second axis of rotation, and (b) a light source connected to said power transfer means to rotate about said first and said second axis of rotation in response to a power input to said power transfer means through said offset power input means.

6. The light fixture defined in claim 5, wherein said light source includes a lamp holder mounted to said mounting arm and a lamp connected to said lamp holder.

7. An adjustable lighting system including, in combination:

(a) a fixture mounting pole, (b) a power transfer means having an offset power input shaft parallel but offset from a first axis of rotation, and a power output means, at least a portion of a power transfer means being connected to said fixture mounting pole, and (c) a light source connected to said output means of said power transfer means to rotate about a first axis in response to the physical rotation of said power transfer means about said first axis, and about a second axis in response to rotation of said offset power input shaft about its own axis.

8. The lighting system defined in claim 7, and further including:

(a) an adjustment means connectable to said power transfer means to operate said offset power input means, and thereby rotate said power output means and said light source.

9. An adjustable lighting system including, in combination:

(a) a track head mountable to a lighting track, (b) a fixture mounting pole connected to said track head, (c) a power transfer means including a housing, an offset power input shaft, and an output shaft, each of said offset power input shaft and said output shaft having an axis, said housing connected to a lower end of said fixture mounting pole, said output shaft rotatable about its own axis in response to the rotation of said input shaft, and said fixture mounting pole rotatable in response to the rotation of said housing, and (d) a lamp holder connected to said output shaft of said power transfer means to rotate about the axis of said fixture mounting pole in response to the rotation of said housing, and about an output shaft axis in response to the rotation of said offset power input shaft, said lamp holder capable of holding a lamp which is electrically connected to said track.

10. The lighting system defined in claim 9, and further including:

(a) an adjustment means connectable to said offset power input shaft of said power transfer means to rotate the output shaft thereof, and thereby rotate said lamp holder about said output shaft axis when desired, and to rotate said power transfer means about said fixture mounting pole when said offset input shaft is orbited about said fixture pole axis.

11. The lighting system defined in claim 10, wherein said adjustment means further include:

(a) a wand connectable at its upper end to said offset input shaft of said power transfer means.

12. The lighting system defined in claim 10, and further including:

(a) power driving means connected to a lower end of said wand for power-assisted rotation of said lamp holder about two different axes.

13. The system defined in claim 12, and further including:

(a) tension adjustment means interposed between said track head and said system mounting pole.

14. The system defined in claim 13, and further including:

(a) a knob connected to said offset power input shaft, and (b) a driver connected to the upper portion of said wand.

15. An adjustable lighting system including, in combination:

(a) a track head mountable to a lighting track, (b) a rotatable fixture mounting pole connecting to said track head, (c) a power transfer means including a housing, an offset power input shaft, and power output shaft, said housing connected to a lower end of said fixture mounting pole, said power output shaft rotatable about its own axis in response to the rotation of said offset power input shaft, and said fixture mounting pole rotatable in response to the orbiting of said offset power input shaft about said fixture mounting pole.

16. The adjustable lighting system defined in claim 15, and further including:

(a) a lamp holder connected to said output shaft of said power transfer means to rotate about a first axis of rotation in response to the orbiting of said offset power input shaft about said fixture mounting pole, and about a second axis in response to the rotation of said offset power input shaft.

17. The adjustable lighting system defined in claim 16, and further including:

(a) a telescoping adjustment means connected to said offset power input shaft of said power transfer means to rotate said output shaft thereof, and thereby rotate said lamp holder about said second axis of rotation when desired, and to orbit said offset power input shaft about said fixture mounting pole to thereby rotate said fixture mounting pole about said first axis of rotation when desired, thus providing for the rotation of said lamp holder about two different axes from a remote location.

18. The adjustable lighting system defined in claim 17, wherein said adjustment means further includes:

(a) a wand removably connectable at its upper end to said offset power input shaft of said power transfer means.

19. The adjustable lighting system defined in claim 18, wherein said wand further includes:

(a) a outer portion, (b) a telescoping inner portion, and (c) an adjustment nut to position the inner portion with regard to the outer portion.

20. An adjustable lighting system including, in combination:

(a) a stationary fixture mounting pole, (b) a power transfer means mounted for rotation to said fixture mounting pole, said power transfer means including a housing, an offset power input shaft, and a power output shaft, said power output shaft rotatable about its own axis in response to the rotation of said offset power input shaft, and said power transfer means rotatable about the axis of said fixture mounting pole in response to the orbiting of said offset power input shaft about said fixture mounting pole.

21. The adjustable lighting system defined in claim 20, and including:

(a) a lamp holder connected to said output shaft of said power transfer means to rotate about said axis of said fixture mounting pole in response to the orbiting of said offset power input shaft about said fixture mounting pole, and about a second axis of rotation in response to the rotation of said offset power input shaft about its own axis.

22. The adjustable lighting system defined in claim 21, and further including:

(a) a telescoping adjustment means connected to said offset power input shaft of said power transfer means to rotate said output shaft thereof, and thereby rotate said lamp holder about said second axis of rotation when desired, and to orbit said offset power input shaft about said fixture mounting pole to thereby rotate said fixture mounting pole about said first axis of rotation when desired, thus providing for the rotation of said lamp holder about two different axes from a remote location.

23. The adjustable lighting system defined in claim 22, wherein said adjustment means further include:

(a) a wand connectable at its upper end to said offset power input shaft of said power transfer means.

24. The lighting system defined in claim 22, wherein said adjustment means further includes:

(a) a wand removably connected at its upper end to said offset power input shaft of said power transfer means.

25. The lighting system defined in claim 24, wherein said wand further includes:

(a) an outer portion, (b) a telescoping inner portion, and (c) an adjustment nut to position the inner portion with regard to the outer portion.

26. An adjustable lighting system including, in combination:

(a) a track head mountable to a lighting track, (b) a fixture mounting pole fixedly mounted to said track head, (c) a power transfer means including a housing rotatably mounted to said fixture pole, an offset power input shaft, and an enlarged power output shaft, each of said power input shaft and said output shaft having an axis, said housing mounted to a lower end of said fixture mounting pole, said output shaft rotatable about said output shaft axis in response to rotation of said offset input shaft, and said housing rotatable about the axis of said fixture mounting pole in response to the application of an orbital force to said offset input shaft, and (d) a light source connected to said output shaft of said power transfer means to rotate about said output shaft axis in response to the rotation of said offset power input shaft, and about said fixture pole axis in response to said orbital input.

27. A lighting system, including a lighting fixture for rotation about a first and a second axis of rotation in response to a power input about a single axis which is offset from said first axis of rotation and parallel thereto, a rotational input about said single offset axis producing rotation about said second axis of rotation, and an orbital input about said single offset axis producing rotation of said lighting fixture about said first axis of rotation.

28. A lighting system including, in combination:

(a) a power transfer means having an output shaft rotatable in response to rotation of an input shaft, the axes of said power input shaft and said power output shaft forming two axes of power output, said power transfer means further having a single node of power input offset from one of said two axes of power output, and (b) a light source connected to said power transfer means for rotation about each of said axes of power output.

29. In an adjustable lighting system:

(a) a power transfer means having a housing, a power input shaft offset from a first axis of rotation, and an output shaft rotatable in response to the rotation of said input shaft, a single node of power input being formed at the intersection of the axes of said power input shaft and said power output shaft in a position offset from the first axis of rotation, (b) a power output means connected to said node of power input to rotate about a second axis of rotation in response to a rotational input to said node, and (c) a light source connected to said power output means to rotate about said second axis of rotation in response to a rotational power input to said power input node, and about said first axis of rotation in response to an orbital input to said node.

30. A recessed adjustable lighting system, including, in combination:

(a) a power transfer means having a single node of power input offset from a first axis of rotation, (b) a light source connected to said power transfer means for rotation about said first axis of rotation and an intersecting second axis of rotation, said rotation about said second axis being in response to a rotational input to said power input node, and for rotation about said first axis of rotation in response to an orbital input to said power input node.

31. A recessed adjustable lighting fixture including, in combination:

(a) a housing having one closed end, (b) a power transfer means connected to said housing at said closed end for rotation about a first axis passing through said connection, said power transfer means having an offset power input means and a power output means, said power output means rotatable in response to a rotational input to said power input means.

32. The recessed adjustable lighting fixture defined in claim 31, and further including:

(a) a light source connected to said power output means to rotate about a second axis of rotation in response to the rotation of said offset power input means, and to rotate about said first axis of rotation in response to an orbital input to said offset power input means.

33. The recessed adjustable lighting fixture defined in claim 32, wherein said offset power input means includes a power input shaft offset from said first axis of rotation, and where said power output means includes a power output shaft.

34. The recessed lighting fixture defined in claim 33, and further including:

(a) an adjustment means connectable to said offset power input shaft of said power transfer means to rotate the output shaft thereof about said output shaft axis, and thereby rotate said lamp holder about said output shaft axis upon rotation of said adjustment means, and to rotate said lamp holder about said first axis upon orbiting of said adjustment means about said first axis, thus providing for the rotation of said lamp holder about two different axes from a remote location.

35. A recessed adjustable lighting fixture including, in combination:

(a) a housing, (b) a bearing base rotatably mounted to said housing, (c) a mounting arm fixed to said bearing base, (d) a gearbox mounted to said mounting arm, said gearbox having a power input shaft and a power output shaft, and (e) a light source connected to said output shaft of said gearbox to rotate about a first axis in response to an orbiting of said input shaft about said first axis, and to rotate about a second axis in response to a rotation of said power input shaft about its axis.

36. A recessed lighting system including, in combination:

(a) a power transfer means having an input shaft coaxial with a single axis of power input, and an output shaft rotatable in response to the rotation of said input shaft, the axis of said output shaft forming an axis of power output, the axis of said input shaft and the axis of said output shaft and the axis of said input shaft intersecting at a single node of power input, and (b) a light source connected to said power transfer means for rotation about each of said two axes of power output in response to a power input.

37. A recessed lighting fixture including, in combination:

(a) a power transfer means having a single offset axis of power input and two axes of power output, one of said two axes of power output being parallel to said single offset axis of power input, and (b) a light source connected to said power transfer means for rotation about each of said two axes of power output in response to rotation of a power input means about said single offset axis of power input.

38. An adjustable lighting system including, in combination:

(a) a track head mountable to a lighting track, (b) a fixture mounting pole connected to said track head, (c) a power transfer means including a housing, an input shaft and an output shaft, each of said input shaft and said output shaft having an axis, said housing connected to a lower end of said fixture mounting pole, said output shaft rotatable about its own axis in response to the rotation of said input shaft, and said fixture mounting pole rotatable in response to the rotation of said housing, and (d) a lamp holder connected to said output shaft of said power transfer means to rotate about an input shaft axis in response to the rotation of said housing, and about an output shaft axis in response to the rotation of said input shaft, said lamp holder capable of holding a lamp which is electrically connected to said track.

39. A recessed adjustable lighting fixture including, in combination:

(a) a housing closed at one end, (b) a platform rotatably mounted to said housing at said closed end thereof, (c) a mounting arm fixedly mounted to said platform, (d) a gearbox mounted to the lower end of said mounting arm, said gearbox having a power input shaft and a power output shaft, and (e) a light source connected to said output shaft of said gearbox to rotate about a first axis in response to an orbiting of said input shaft about said first axis, and to rotate about a second axis in response to a rotation of said power input shaft about it its axis.

40. An adjustable lighting fixture including, in combination:

(a) a fixture mounting pole, said fixture mounting pole including a bushing portion connected to or integral with said fixture mounting pole, (b) a shaft journaled for rotation in said bushing portion, (c) a luminaire connected to said shaft for rotation about the axis of said shaft when said shaft is rotated about its axis, (d) friction means interposed between said luminaire and said bushing portion of said fixture mounting pole, and (e) a ring attached to said luminaire.

41. The adjustable lighting fixture defined in claim 40, wherein said luminaire includes:

(a) a gimbal ring attached to said shaft for rotation thereby, (b) a lamp held in place in said gimbal ring, (c) a lamp socket electrically connected to said lamp, and (d) a second ring attached to said gimbal ring.

42. An adjustable lighting fixture including, in combination:

(a) a fixture mounting pole, said fixture mounting pole including a bushing portion at the lower end thereof, (b) a shaft journaled for rotation in said bushing portion, (c) a luminaire connected to one end of said shaft for rotation about the axis of said shaft when said shaft is rotated about its axis, and (d) a ring attached to the other end of said shaft.

43. The adjustable lighting fixture defined in claim 42 and further including:

(a) friction means interposed between said luminaire and said bushing portion of said fixture mounting pole.

44. A method of converting a conventional track light of the type having a track head mountable to a lighting track, and a fixture mounting pole connected at its upper end to said track head, and at its lower end to a lighting fixture, to a track light wherein said lighting fixture can be rotated about two intersecting axis from a remote location, said method including the steps of:

(a) disconnecting said lighting fixture from said fixture mounting pole, (b) providing at a point of connection between said lighting fixture and said fixture mounting pole a power transfer means of a type having an output shaft rotatable in response to rotation of an offset input shaft, and having a housing fixedly connected to said fixture mounting pole, (c) attaching a shaft receiving means to said lighting fixture to receive said output shaft of said power transfer means, (d) connecting said output shaft to said shaft receiving means, and (e) providing an adjustment means connectable to said input shaft of said power transfer means to rotate the same, and thereby rotate said lighting fixture about a first axis when desired, and to said housing of said power transfer means to rotate said fixture mounting pole when desired, thereby rotating said lighting fixture a second axis when desired.

45. A method of converting a conventional track lighting of a type having a track head mountable to a lighting track, and a fixture pole connected at its upper end to said track head, and at a lower end to a lighting fixture, to a track light wherein said lighting fixture can be rotated about two intersecting axes from a remote location, said method including the steps of:

(a) disconnecting said lighting fixture from said fixture mounting pole, (b) replacing said fixture mounting pole with a new fixture mounting pole of a type having a power transfer means including an output shaft and an offset power input shaft on the lower end of said fixture mounting pole of a type having an output shaft rotatable in response to rotation of an input shaft, and its housing connected to said fixture mounting pole, (c) attaching a shaft receiving means to said lighting fixture to receive said output shaft of said power transfer means, (d) connecting said output shaft to said shaft receiving means, and (e) providing an adjustment means connectable to said input shaft of said power transfer means to rotate the same, and thereby rotate said lighting fixture about a first axis when desired, and to said housing of said power transfer means to rotate said fixture pole when desired thereby rotating said lighting fixture about a second axis when desired.

46. A method of converting a conventional track light of a type having a track head mountable to a lighting track, and a fixture mounting pole connected at its upper end to said track head, and at its lower end to a lighting fixture, to a track light wherein said lighting fixture can be rotated about two intersecting axis from a remote location, said method including the steps of, (a) disconnecting said lighting fixture from said fixture mounting pole, (b) providing at a point of connection between said lighting fixture and said fixture mounting pole a power transfer means of a type having an output shaft rotatable in response to rotation of an offset input shaft and having a housing fixedly connected to said fixture mounting pole, (c) attaching a shaft receiving means to said lighting fixture to receive said output shaft of said power transfer means, (d) connecting said output shaft to said shaft receiving means, and, (e) providing an adjustment means connectable to said output shaft of said power transfer means to rotate the same, and thereby rotate said lighting fixture in a first plane when desired, and to said housing of said power transfer means to rotate said fixture mounting pole when desired, thereby rotating said lighting fixture in the second plane when desired.

* * * * *